US006055746A

United States Patent [19]

Lyden et al.

[11] Patent Number: 6,055,746

[45] **Date of Patent: *May 2, 2000**

[54] ATHLETIC SHOE WITH REARFOOT STRIKE ZONE

[75] Inventors: Robert M. Lyden; Gordon A. Valiant, both of Beaverton; Robert J. Lucas; Michael T. Donaghu, both of Portland, all of Oreg.; David M. Forland, Battle Ground, Wash.; Joel L. Passke; Thomas McGuirk, both of Portland, Oreg.; Lester Q. Lee, Gaston, Oreg.

[73] Assignee: Nike, Inc., Beaverton, Oreg.

[ * ] Notice: This patent is subject to a terminal disclaimer.

[21] Appl. No.: 08/851,387

[22] Filed: May 5, 1997

Related U.S. Application Data

[63] Continuation of application No. 08/481,697, Jun. 7, 1995, Pat. No. 5,625,964, which is a continuation-in-part of application No. 08/038,950, Mar. 29, 1993, Pat. No. 5,425,184.

[51] Int. Cl.[7] ..... A43B 13/20

[52] U.S. Cl. ..... 36/29; 36/114; 36/59 C; 36/102

[58] Field of Search ..... 36/102, 88, 103, 36/114, 25 R, 28, 29, 34 R, 35 R, 35 B, 59 C

[56] References Cited

U.S. PATENT DOCUMENTS

| | | |
|---|---|---|
| 30,037 | 7/1860 | Ausdall . |
| D. 86,527 | 3/1932 | Klein . |
| D. 115,636 | 7/1939 | Sperry . |
| 248,616 | 10/1881 | Shepard . |
| D. 278,851 | 5/1985 | Austin . |
| 280,791 | 7/1883 | Brooks . |
| D. 288,027 | 2/1987 | Tonkel . |
| D. 298,483 | 11/1988 | Liggett et al. . |
| D. 348,150 | 6/1994 | Lucas . |
| D. 348,350 | 7/1994 | Lucas . |
| D. 348,354 | 7/1994 | Lucas . |
| 500,385 | 6/1893 | Hall . |
| 863,873 | 8/1907 | Pratt . |
| 900,867 | 10/1908 | Miller . |
| 940,856 | 11/1909 | Critz, Jr. . |

(List continued on next page.)

FOREIGN PATENT DOCUMENTS

| | | |
|---|---|---|
| 0 083 449 | 7/1983 | European Pat. Off. . |
| 0 096 543 | 12/1983 | European Pat. Off. . |
| 0 316 289 | 5/1989 | European Pat. Off. . |

(List continued on next page.)

OTHER PUBLICATIONS

Footstrike Patterns in Distance Running, B.A. Kerr et al., *Biomechanical Aspects of Sports Shoes and Playing Surfaces*, Calgary, Canada, Aug. 1983, pp. 135–142.

Pronation and Sport Shoe Design, A. Atacoff and X. Kaelin, *Biomechanical Aspects of Sports Shoes and Playing Surfaces*, Calgary, Canada, Aug. 1983, pp. 143–151.

The Running Shoe Book, by Peter R. Cavanagh, Ph.D., 1980, pp. 35–36, 170–171.

(List continued on next page.)

*Primary Examiner*—Ted Kavanaugh

*Attorney, Agent, or Firm*—Banner & Witcoff, Ltd.

[57] ABSTRACT

An athletic shoe has a sole with a rearfoot strike zone segmented from the remaining heel area by a line of flexion which permits articulation of the strike zone during initial heel strike of a runner. The line of flexion is located to delimit a rearfoot strike zone reflecting the heel to toe running style of the majority of the running population. In addition to allowing articulation of the rearfoot strike zone about the line of flexion, the sole incorporates cushioning elements, including a resilient gas filled bladder, to provide differential cushioning characteristics in different parts of the heel, to attenuate force applications and shock associated with heel strike, without degrading footwear stability during subsequent phases of the running cycle. The line of flexion may be formed by various means including a deep groove, a line of relatively flexible midsole material, and a relatively flexible portion of a segmented fluid bladder.

22 Claims, 9 Drawing Sheets

U.S. PATENT DOCUMENTS 1,304,915 5/1919 Spinney .
1,850,752 3/1932 Ice et al. .
1,855,452 4/1932 Jones .
2,090,881 8/1937 Wilson .
2,124,986 7/1938 Pipes .
2,155,166 4/1939 Kraft .
2,162,912 6/1939 Craver .
2,177,116 7/1939 Persichino .
2,206,860 7/1940 Sperry .
2,244,504 6/1941 Riddell .
2,328,242 8/1943 Witherill .
2,345,831 4/1944 Pierson .
2,470,200 5/1949 Wallach .
2,488,382 11/1949 Davis .
2,597,393 5/1952 Slampa .
2,599,871 6/1952 Slampa .
2,629,189 2/1953 Stein .
2,677,906 5/1954 Reed .
2,717,462 9/1955 Goin .
2,723,468 11/1955 Marcy .
2,922,235 1/1960 Meltzer .
3,005,272 10/1961 Shelare et al. .
3,044,190 7/1962 Urbany .
3,087,262 4/1963 Russell .
3,295,230 1/1967 Szerenyi et al. .
3,487,563 1/1970 Austin .
3,757,434 9/1973 Granger, Jr. .
3,765,422 10/1973 Smith .
3,849,915 11/1974 Inohara .
3,967,390 7/1976 Anfruns .
4,043,058 8/1977 Hollister et al. .
4,059,910 11/1977 Bryden et al. .
4,115,934 9/1978 Hall .
4,128,950 12/1978 Bowerman et al. .
4,129,951 12/1978 Petrosky .
4,180,924 1/1980 Subotnick .
4,183,156 1/1980 Rudy .
4,217,705 8/1980 Donzis .
4,219,945 9/1980 Rudy .
4,237,625 12/1980 Cole et al. .
4,241,524 12/1980 Sink .
4,255,877 3/1981 Bowerman .
4,259,792 4/1981 Halberstadt .
4,262,435 4/1981 Block et al. .
4,263,728 4/1981 Frecentese .
4,266,349 5/1981 Schmohl .
4,272,899 6/1981 Brooks .
4,287,250 9/1981 Rudy .
4,288,929 9/1981 Norton et al. .
4,297,797 11/1981 Meyers .
4,302,892 12/1981 Adamik .
4,305,212 12/1981 Coomer .
4,309,832 1/1982 Hunt .
4,314,413 2/1982 Dassler .
4,340,626 7/1982 Rudy .
4,354,318 10/1982 Frederick et al. .
4,364,188 12/1982 Turner et al. .
4,364,189 12/1982 Bates .
4,377,041 3/1983 Alchermes .
4,393,605 7/1983 Spreng .
4,439,936 4/1984 Clarke et al. .
4,445,283 5/1984 Meyers .
4,449,306 5/1984 Cavanagh .
4,476,638 10/1984 Quacquarini et al. .
4,506,462 3/1985 Cavanagh .
4,527,345 7/1985 Lopez et al. .
4,546,556 10/1985 Stubblefield .
4,550,510 11/1985 Stubblefield .
4,551,930 11/1985 Graham et al. .
4,554,749 11/1985 Ostrander .
4,557,059 12/1985 Misevich et al. .
4,561,140 12/1985 Graham et al. .
4,562,651 1/1986 Frederick et al. .
4,570,362 2/1986 Vermonet .
4,615,126 10/1986 Mathews .
4,628,936 12/1986 Langer et al. .
4,638,577 1/1987 Riggs .
4,654,983 4/1987 Graham et al. .
4,676,010 6/1987 Cheskin .
4,694,591 9/1987 Banich et al. .
4,722,131 2/1988 Huang .
4,724,622 2/1988 Mills .
4,724,624 2/1988 Duclos .
4,730,402 3/1988 Norton et al. .
4,731,939 3/1988 Parracho et al. .
4,744,157 5/1988 Dubner .
4,745,927 5/1988 Brock .
4,759,136 7/1988 Stewart et al. .
4,768,295 9/1988 Ito .
4,777,738 10/1988 Giese et al. .
4,779,359 10/1988 Famolare, Jr. .
4,779,361 10/1988 Kinsaul .
4,782,603 11/1988 Brown .
4,785,557 11/1988 Kelley et al. .
4,794,707 1/1989 Franklin et al. .
4,815,221 3/1989 Diaz .
4,817,304 4/1989 Parker et al. .
4,837,949 6/1989 DuFour .
4,854,057 8/1989 Misevich et al. .
4,858,340 8/1989 Pasternak .
4,864,739 9/1989 Maestri .
4,876,053 10/1989 Norton et al. .
4,934,072 6/1990 Frederickson et al. .
4,942,677 7/1990 Flemming et al. .
4,989,349 2/1991 Ellis, III .
5,005,299 4/1991 Whatley .
5,012,597 5/1991 Thomasson .
5,024,007 6/1991 DuFour .
5,046,267 9/1991 Kilgore et al. .
5,048,203 9/1991 Kling .
5,052,130 10/1991 Barry et al. .
5,077,915 1/1992 Gross .
5,097,607 3/1992 Frederickson .
5,131,173 7/1992 Anderie .
5,152,081 10/1992 Hallenbeck et al. .
5,155,927 10/1992 Bates et al. .
5,191,727 3/1993 Barry et al. .
5,195,256 3/1993 Kim .
5,197,206 3/1993 Shorten .
5,197,207 3/1993 Shorten .
5,201,125 4/1993 Shorten .
5,220,737 6/1993 Edington .
5,297,349 3/1994 Kilgore et al. .
5,313,717 5/1994 Allen et al. .
5,317,819 6/1994 Ellis, III .
5,343,639 9/1994 Kilgore et al. .
5,353,459 10/1994 Potter et al. .
5,353,523 10/1994 Kilgore et al. .
5,363,570 11/1994 Allen et al. .
5,381,607 1/1995 Sussmann .
5,396,675 3/1995 Vincent et al. .
5,448,839 9/1995 Blissett et al. .

FOREIGN PATENT DOCUMENTS 0 467 506 1/1992 European Pat. Off. .
0 500 247 8/1992 European Pat. Off. .
0 549 962 A1 7/1993 European Pat. Off. .
337366 4/1904 France .
22515 7/1921 France .
997424 1/1952 France .

| | | |
|---|---|---|
| 1 122 168 | 9/1956 | France . |
| 2 614 510 | 11/1988 | France . |
| 660 551 | of 0000 | Germany . |
| 680 698 | 8/1939 | Germany . |
| 1 290 844 | 3/1969 | Germany . |
| 29 27 635 | 1/1981 | Germany . |
| 37 41 444 | 7/1988 | Germany . |
| 4 018 518 | 1/1991 | Germany . |
| 3 927 617 | 2/1991 | Germany . |
| 59-23525 | 7/1984 | Japan . |
| 183641 | 8/1922 | United Kingdom . |
| 471179 | 8/1937 | United Kingdom . |
| 856622 | 12/1960 | United Kingdom . |
| 2 050 145 | 1/1981 | United Kingdom . |
| 2 134 770 | 8/1984 | United Kingdom . |
| 2 226 746 | 7/1990 | United Kingdom . |
| 2 228 178 | 8/1990 | United Kingdom . |
| WO 5/03528 | 10/1983 | WIPO . |
| WO 90/00358 | 1/1990 | WIPO . |
| WO 91/03180 | 3/1991 | WIPO . |
| WO 91/04683 | 4/1991 | WIPO . |
| WO 91/05491 | 5/1991 | WIPO . |
| WO 91/10377 | 7/1991 | WIPO . |
| WO 91/11124 | 8/1991 | WIPO . |
| WO 91/11924 | 8/1991 | WIPO . |
| WO 91/19429 | 12/1991 | WIPO . |
| WO 92/07483 | 5/1992 | WIPO . |
| 9 300 0838 | 1/1993 | WIPO . |

OTHER PUBLICATIONS

Sport Research Review, Women in Sports, Nike, Inc., Mar./Apr. 1990.
Photograph from *Athletic Footwear*, by Melvyn P. Cheskin, 1987, p. 19.
Turntec Ad, Runner, May 1986.
Physical Therapy, Volume 64, No. 12, Dec. 1984, pp. 1886–1901.
Biomechanics of Distance Running, Peter R. Cavanagh, PhD., 1990, pp. 154–158, 217.
Racing and Sports Car Chassis Design, Michael Costin and David Phipps, 1971.
Shoe Modifications in Lower–Extremity Orthotics, Isidore Zamosky, pp. 54–95.
Fall 1991 Nike Footware Catalog.
Spring 1992 Nike Footware Catalog.
Fall 1992 Nike Footware Catalog.
Spring 1993 Nike Footware Catalog, Jun., 1992.
Biomechanics of Running Shoes, Benno M. Nigg, Dr. sc. nat., 1986, p. 151.
Biomechanics IX–B, David A. Winter, Ph.D., et al., 1985, pp. 101–105.
Addidas Ad.
Runner's World "Totally Tubular" article, discussing Adidas Tubular 2 and Tubular 4 shoes, Aug. 1993.
Adidas Product Manual, Tubular 2 (undated).

ATHLETIC SHOE WITH REARFOOT STRIKE ZONE

This application is a continuation of application Ser. No. 08/481,697, filed Jun. 7, 1995, now U.S. Pat. No. 5,625,964, which is a continuation-in-part of Ser. No. 38,950, filed Mar. 29, 1993, now U.S. Pat. No. 5,425,184.

BACKGROUND OF THE INVENTION

The invention pertains to footwear, and in particular to athletic footwear used for running. More specifically, the present invention pertains to athletic shoe constructions designed to attenuate force applications and shock and to enhance stability upon rearfoot strike during running.

The modern athletic shoe is a highly refined combination of elements which cooperatively interact in an effort to minimize weight while maximizing comfort, cushioning, stability and durability. However, these goals are potentially in conflict with each other in that efforts to achieve one of the objectives can have a deleterious effect on one or more of the others. As a result, the shoe industry has continued in its efforts to optimize these competing concerns. These efforts have in large part been directed at optimizing the competing qualities of cushioning and stability.

In modern athletic shoes, the sole ordinarily has a multi-layer construction comprised of an outsole, a midsole and an insole. The outsole is normally formed of a durable material such as rubber to resist wearing of the sole during use. In many cases, the outsole includes lugs, cleats or other elements to enhance traction. The midsole ordinarily forms the middle layer of the sole and is typically composed of a soft foam material to cushion the impact forces experienced by the foot during athletic activities. An insole layer is usually a thin padded member provided over the top of the midsole to enhance shoe comfort.

Up until the 1970's, athletic shoes were by and large considered deficient in providing cushioning for the wearer's foot. Consequently, numerous foot related injuries were sustained by those engaging in athletic activities. To overcome these shortcomings, over the ensuing years manufacturers focused their attention upon enhancing the cushioning provided by athletic shoes. To this end, midsoles have over time increased in thickness. These endeavors have further led to the incorporation of special cushioning elements within the midsoles intended to provide enhanced cushioning effects. In particular, the use of resilient inflated bladder midsole inserts, e.g., in accordance with the teachings of U.S. Pat. Nos. 4,183,156, 4,219,945, 4,340,626 to Rudy, and U.S. Pat. No. 4,813,302 to Parker et al., represents a marked improvement in midsole design and has met with great commercial success. (These patents are hereby incorporated by reference herein.) The industry's focus on improving cushioning effect has greatly advanced the state of the art in athletic shoe design. In some cases, however, the benefits realized in cushioning have been offset by a degradation of shoe stability.

To appreciate the potentially harmful effects of shoe instability, it is important to have a basic understanding of the dynamics of running and the anatomy of the foot. While the general population includes a wide variety of running styles, about 80% of the population runs in a heel-to-toe manner. In this prevalent running style, the foot does not normally engage the ground in a simple back to front linear motion.

When most persons run, their feet generally engage the ground under the approximate midline of their body, rather than to the sides as in walking. As a result, the foot is tilted upon ground contact such that initial engagement with the ground (commonly referred to as rearfoot strike or heel strike) usually occurs on the lateral rear corner of the heel. (See FIG. 1.) At heel strike, the foot is ordinarily dorsi flexed and slightly inverted. Typically, the ankle angle $\alpha$ is within approximately between 7° plantarflexion and 12° dorsiflexion, and the angle of inversion $\beta$ is approximately 6°. Furthermore, at heel strike the foot is typically abducted outwardly from the straight forward direction (A) at an angle $\gamma$ from 10° to 14°. In this respect, see also U.S. Pat. No. 4,439,936 to Clark et al., which is hereby incorporated by reference herein. As the ground support phase progresses, the foot is lowered to the ground in a rotative motion such that the sole comes to be placed squarely against the ground. Inward rotation of the foot is known as eversion, and in particular, inward rotation of the calcaneus associated with articulation of the sub-talar joint is known as rearfoot pronation. While eversion is itself a natural action, excessive rearfoot pronation, or an excessive rate of pronation is sometimes associated with injuries among runners and other athletes.

Referring to FIGS. 2 and 3, it is seen that the foot is interconnected to the leg via the tarsus (the posterior group of foot bones). More specifically, the tibia 1 and fibula 3 (i.e., the leg bones) are movably attached to the talus 5 to form the ankle joint. In general, the leg bones 1, 3 form a mortise into which a portion of talus 5 is received to form a hinge-type joint which allows both dorsi flexion (upward movement) and plantar flexion (downward movement) of the foot. Talus 5 overlies and is movably interconnected to the calcaneus 7 (i.e., the heel bone) to form the sub-talar joint. The sub-talar joint enables the foot to move in a generally rotative, side to side motion. Rearfoot pronation and supination of the foot is generally defined by movement about this joint. Along with talus 5 and calcaneus 7, the tarsus further includes navicular 9, cuboid 11 and the outer, middle and inner cuneiforms 13, 15 and 17. The cuboid and cuneiforms facilitate interconnection of the tarsus to the metatarsals (the middle group of foot bones). Generally, the rearfoot area is considered to extend to the junction 19 between the calcaneus 7 and cuboid 11.

As mentioned, an industry trend has been toward thickening the midsoles of athletic shoes to enhance the cushioning effect of the sole. An added thickness of foam, however, can cause the sole to have increased stiffness in bending. Under these conditions, the lateral rear corner of the sole can tend to operate as a fulcrum upon heel strike and create an extended lever arm and greater moment, which can cause the foot to rotate medially and pronate with greater velocity than is desirable. This can lead to over-pronation of the foot and possible injury. Further, this condition can present a potentially unstable condition for the foot and results in the transmission of higher than desired levels of impact stress due to the relatively small surface area of contact and the relative stiffness of a conventional sole having a higher density foam sidewall, and therefore greater stiffness in the area of heel strike.

The footwear industry has wrestled with the aforementioned bio-mechanical phenomena associated with rearfoot strike for years, and various strategies have been directed towards reducing rearfoot impact shock, increasing stability and/or discouraging over-pronation.

It is known to use deep grooves, channels or slits in order to increase sole flexibility in the heel area. Two early teachings involve segmentation of a rigid sole of a street shoe, in order to reduce heel shock and to promote a more natural walking action. See Stein U.S. Pat. No. 2,629,189 and German Patent No. 680,698 to Thomsen et al. (1939). More recent teachings involving athletic shoes are disclosed in Hunt U.S. Pat. No. 4,309,832; Riggs U.S. Pat. No. 4,638,577; and Ellis PCT Applications Nos. WO 91/05491, WO 92/07483, WO 91/11924 and WO 91/19429.

Another approach taken in the prior art for minimizing the shock and over-pronation associated with heel strike involves the use of a relatively compliant midsole material in a lateral heel area and a stiffer material on a medial side. See, e.g., Cavanagh U.S. Pat. No. 4,506,462 and Bates U.S. Pat. No. 4,364,189.

The above-described segmented soles of the prior art do not adequately address the aforementioned heel strike dynamics of most runners. Typically, the application to shoe soles of grooves, slits, and materials exhibiting differential cushioning characteristics have involved excessively large heel and midfoot regions, whereby less than ideal medial and lateral stability results. In other words, the prior art has failed to properly delimit a rearfoot strike zone wherein heel strike occurs with the vast majority of runners. Through the misplacement or over placement of flex grooves or the like, medial and lateral instability in the heel and mid-foot regions can result. Similarly, the extension of a softer sole material beyond the critical heel strike area about medial and lateral sides of the heel can adversely affect footwear stability.

It is known to incorporate into the sole of a running shoe cushioning elements including resilient inflated bladders, such as taught in the aforementioned Rudy U.S. Pat. Nos. 4,183,156, 4,340,626 and 4,219,945, and U.S. Pat. No. 4,817,304 to Parker et al. Soles incorporating gas filled bladder elements in accordance with these patents represent a great advance in athletic footwear cushioning technology. They provide a significant improvement in protection from impact stress as compared with soles formed of conventional plastic foam, by exhibiting a more linear spring characteristic throughout their range of compression and thereby transmitting lower levels of shock to a wearer during use. They also have the advantage of significantly reduced weight. Additionally, soles in accordance with the aforementioned patents have proven to be highly durable and long lasting. Conventional foam soles can break down and take on compression set after a relatively short period of usage. The inclusion of a resilient fluid bladder in the sole greatly reduces compression set due to the reduced reliance on degradable foam plastic to provide a cushioning effect.

The aforementioned Ellis PCT application No. WO 91/11924 discloses the adaptation of a conventional gas filled bladder cushioning device to a sole including spaced longitudinal deformation sipes (slits or grooves). In this embodiment, the gas-filled devices are unconnected tube-shaped chambers located in parallel and between the deformation sipes. The disclosed arrangement would provide substantially uniform flexibility and cushioning across the entire heel area, including the medial side, thus possibly resulting in a degradation of medial stability and a tendency towards over-pronation. Additionally, the longitudinal orientation of the sipes would not provide optimal articulation of the heel area to attenuate shock on rearfoot strike.

A prior art NIKE® walking shoe (the AIR PROGRESS®) has a single deep flex groove running substantially transversely across the sole in the heel area. A segmented gas filled bladder has chambers in fluid communication positioned on either side of the groove, and an area of enhanced flexibility aligned with the flex groove. This shoe advantageously provides some of the improved cushioning characteristics that a gas-filled bladder can afford, while allowing relatively unimpeded articulation about the hinge line. While this shoe works well for walking, which typically involves a heel strike centered about the longitudinal axis of the sole, the strike zone is not properly delimited to account for rearfoot strike during running. Furthermore, the sole does not provide differential cushioning in different zones to attenuate force applications and shock while at the same time enhancing stability.

It is known to incorporate into an athletic shoe relatively rigid motion control elements for controlling pronation and stabilizing the heel. For example, U.S. Pat. No. 5,046,267 to Kilgore et al. (incorporated by reference herein) discloses a plastic motion control device (FOOTBRIDGE®) incorporated into a midsole and extending across the footbed in order to gradually increase the resistance to compression of the midsole from the lateral side to a maximum along the medial side, and thereby control rearfoot pronation.

So-called heel counters are commonly incorporated into athletic and other shoes for properly positioning and providing stability to the heel and arch of the foot. Heel counters are generally formed of relatively rigid material (as compared to the primary upper and midsole materials) and extend upwardly from the sole co-extensive with a portion of the upper, in the heel area on both lateral and medial sides thereof. Typically, a heel counter will surround or cup the heel as a single rigid piece. An integrally formed rearfoot motion control device (FOOTBRIDGE®) and heel support (heel counter) is disclosed in the present Assignee's copending application Ser. No. 07/659,175 (incorporated by reference herein).

The Nike® AIR HUARACHE® has a heel counter which is split into upstanding lateral and medial panel portions affixed to the upper in the region of the heel. This shoe sole has a conventional sole including a gas filled bladder, without means for providing differential cushioning and/or independent articulation between a rearfoot strike zone and a remaining heel area.

U.S. Pat. Nos. 4,445,283 and 4,297,797 to Meyers disclose the use of a relatively firm fluid tight chamber in a medial heel area of a sole and a relatively compressible chamber in a lateral heel area, so as to create greater weight bearing on the lateral side such that the medial side may form a supportive arch when the lateral side deforms. The Meyers bladder also includes a transversely extending groove or split in a midfoot region for providing flexibility. Meyers does not delimit an articulated rearfoot strike zone reflecting the dynamics and location of heel strike in most runners.

Coomer U.S. Pat. No. 4,305,212 discloses an arrangement of gas filled bladders having differential pressures in different parts of the heel area of the sole. Central lower pressure zones are surrounded by a high pressure zone extending about the rear part of the sole from a lateral to medial side, in order to capture or catch the heel in a neutral position. Due to the increased pressure in the area where heel strike will occur, less than ideal attenuation of force applications and shock on heel strike would result. Furthermore, the design does not delimit an articulated rearfoot strike zone reflecting the dynamics and location of heel strike in most runners.

SUMMARY OF THE INVENTION

In view of the foregoing, it is a principal object of the invention to provide an athletic shoe that optimizes the competing concerns of cushioning and stability associated with the ground support phase of the running cycle, and in particular rearfoot strike during running.

It is a more specific object of the invention to configure within an athletic shoe sole an articulated rearfoot strike zone and elements providing differential cushioning, so as to attenuate force applications and shock, and reduce instability associated with rearfoot strike without introducing instabilities into subsequent phases of the running cycle.

It is still another object of the invention to integrate within an athletic shoe sole an articulated rearfoot strike zone and a relatively rigid heel support element, so as to achieve the aforementioned objects while adequately supporting and positioning the heel and arch of the foot within the shoe.

It is yet another object of the invention to provide in an athletic shoe sole a segmented rearfoot strike one delimited in such a manner as to take account of the range of rearfoot strike areas of most runners, without adversely affecting medial and lateral stability.

These and other objects are achieved by athletic footwear in accordance with the present invention. Such athletic footwear comprises an upper and a sole attached to the upper. The sole includes a cushioning midsole portion extending over a heel area of the sole. The sole has a rearfoot strike zone located at a rear lateral corner of said heel area. The rearfoot strike zone is articulated in relation to the remaining heel area about a line of flexion delimiting the rearfoot strike zone. The midsole portion comprises differential cushioning means for reducing the compressive stiffness of the midsole portion within the rearfoot strike zone, relative to at least a medial side of the remaining heel area. The differential cushioning means includes a resilient fluid bladder chamber positioned within the rearfoot strike zone.

In another aspect, athletic footwear in accordance with the present invention comprises an upper, a sole attached to the upper, and a relatively rigid heel support member incorporated into the sole. The sole includes a cushioning midsole portion extending over a heel area of the sole, and has a rearfoot strike zone located at a rear lateral corner of the heel area. The rearfoot strike zone is articulated in relation to the remaining heel area about a line of flexion delimiting the rearfoot strike zone. The heel support member comprises separate lateral and medial segments extending upwardly coextensive with a portion of the upper in the heel area on lateral and medial sides thereof, respectively. The lateral and medial segments are articulated in relation to each other through the midsole portion, whereby the heel support member does not significantly impede articulation of the rearfoot strike zone about the line of flexion.

In yet another aspect, athletic footwear in accordance with the present invention comprises an upper and a sole attached to the upper. The sole includes a cushioning midsole portion extending over a heel area of said sole and a line of flexion delimiting a rearfoot strike zone at a rear lateral corner of the heel area. The line of flexion extends from a first end located along a rear medial side of the sole to a second end located along a lateral side of the sole. The second end is adjacent to or rearward of a nominal location of the junction of the calcaneus and cuboid bones of the foot. The first end is located such that a line drawn from a nominal location of the weight bearing center of the heel to the first end forms a 10° to 50° angle with a central longitudinal axis of the sole. The rearfoot strike zone is articulated with respect to the remaining heel area about the line of flexion. The midsole portion comprises a resilient segmented fluid bladder having a first chamber positioned within the rearfoot strike zone and a second chamber extending within the remaining heel area. The first chamber and second chamber are articulated in relation to each other through a relatively flexible bladder portion forming, at least in part, the line of flexion.

In still another aspect, athletic footwear in accordance with the present invention comprises an upper and a sole attached to the upper. The sole includes a cushioning midsole portion extending over a heel area of said sole, and a rearfoot strike zone located at a rear lateral corner of said heel area. The rearfoot strike zone is articulated in relation to the remaining heel area along a line of flexion delimiting the rearfoot strike zone. The midsole portion comprises a segmented fluid bladder having a first chamber located within the rearfoot strike zone, a second chamber extending within a central portion of the remaining heel area, about a nominal location of the weight bearing center of the heel, and a third chamber extending along a medial side portion of said remaining heel area. The first chamber is articulated with respect to each of said second and third chambers through a relatively flexible bladder portion connecting the first chamber with at least one of the second and third chambers. The line of flexion is formed along the relatively flexible bladder portion. The first chamber exhibits a lesser compressive stiffness than said third chamber, whereby enhanced cushioning is obtained in the rearfoot strike zone while maintaining medial stability.

These and other more specific objects and features of the present invention will be apparent and fully understood from the following detailed description of the preferred embodiments, taken in connection with the appended drawings.

DETAILED DESCRIPTION OF THE PREFERRED EMBODIMENTS

The rearfoot strike zone of the invention is a portion of the heel area of the sole delimited by a line of flexion about which the rearfoot strike zone is articulated in relation to the remaining heel area. "Line of flexion" as used herein refers to a line of action, rather than a physical element of the sole per se, about which articulation of the rearfoot strike zone occurs. Independent articulation of the strike zone increases the surface area of ground contact occurring at heel strike from a narrow edge-like strip extending along the rear lateral sidewall of the sole to a wider planar area extending inwardly of the sidewall. This results in increased stability, enhanced attenuation of force applications and shock, and a reduced medial moment. Attenuation of the shock associated with heel strike is also enhanced by the provision of means for reducing the compressive stiffness of the midsole within the rearfoot strike zone.

Figure 1:
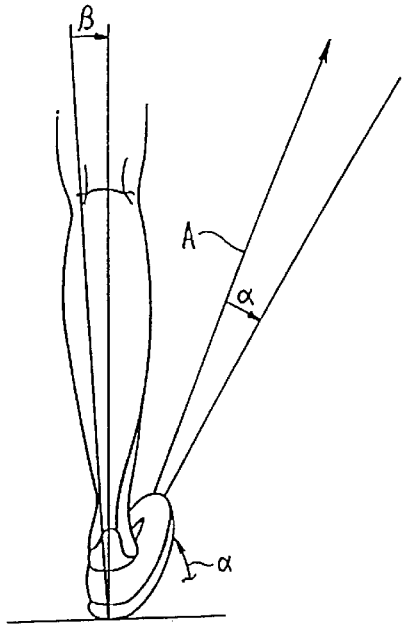
FIG. 1 is a diagrammatic view illustrating a typical orientation of the foot at heel strike.

A primary objective in the placement of the line of flexion is to properly delimit a rearfoot strike zone having enhanced cushioning. The rearfoot strike zone should encompass the range of heel strike locations for most runners, without adversely affecting medial and lateral stability during the braking and propulsive portions of the ground support phase. The orientation of the foot at heel strike is described in the background section and shown in FIG. 1. This orientation places the area of rearfoot strike (during running) for most persons within a range about the rear lateral corner of the sole. Hence, the rearfoot strike zone should be positioned in this area.

Figure 3:
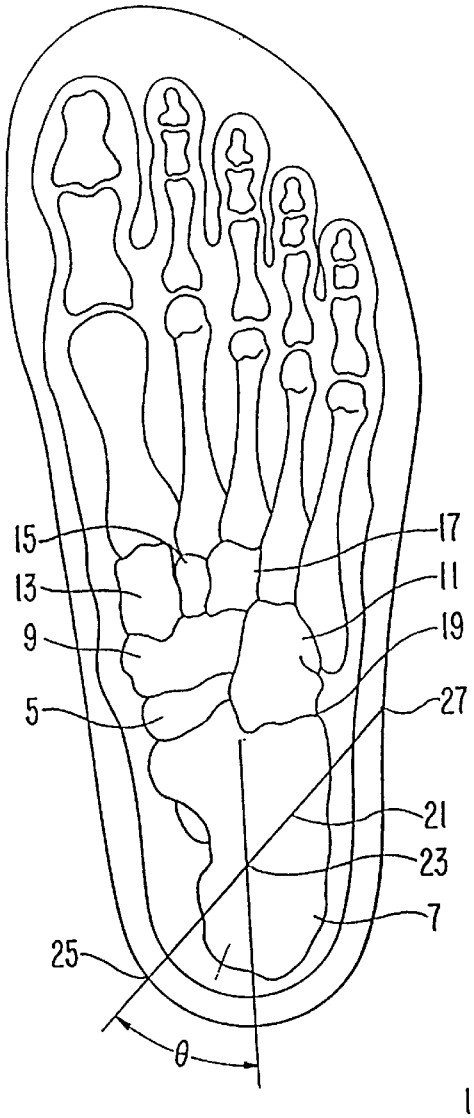
FIG. 3 is a bottom or plantar view of the bones of the human foot, superimposed within a diagrammatic illustration of a shoe sole in accordance with the present invention.

FIG. 3 illustrates diagrammatically a line of flexion 21 delimiting a rearfoot strike zone in accordance with the present invention. On the lateral side, there is no need for the rearfoot strike zone to extend beyond the junction 19 of the calcaneus 7 and cuboid 11 bones of the foot—generally considered to be the limit of the rearfoot area. In fact, it has been observed that rearfoot strike generally occurs well rearward of this point so that the rearfoot strike zone may be shortened accordingly. Extension of a more compliant rearfoot strike zone in accordance with the present invention, beyond the junction 19 of the calcaneus and cuboid could begin to degrade lateral stability in the midfoot region, particularly during stance and the early stages of the propulsive portion of ground support phase, and particularly for those exhibiting a propensity for over-supination (an excessive rolling of the foot outward toward the lateral side).

Figure 2:
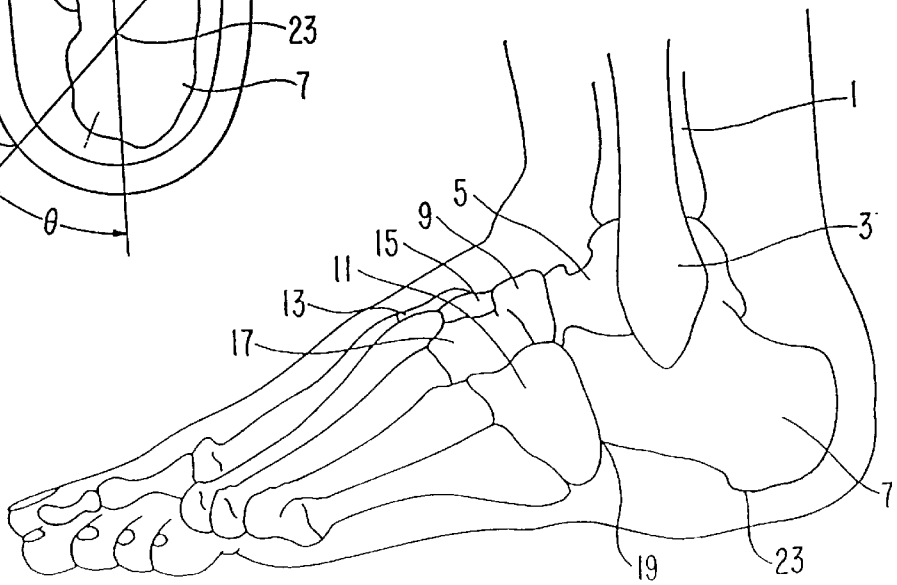
FIG. 2 is a lateral side view of the bones of the human foot.
Figure 4:
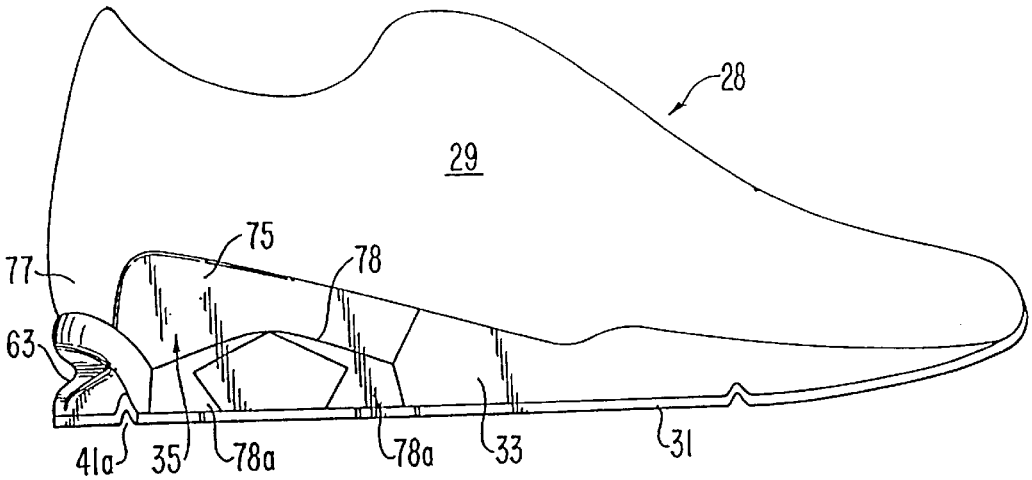
FIG. 4 is a medial side view of a shoe in accordance with the present invention.
Figure 5:
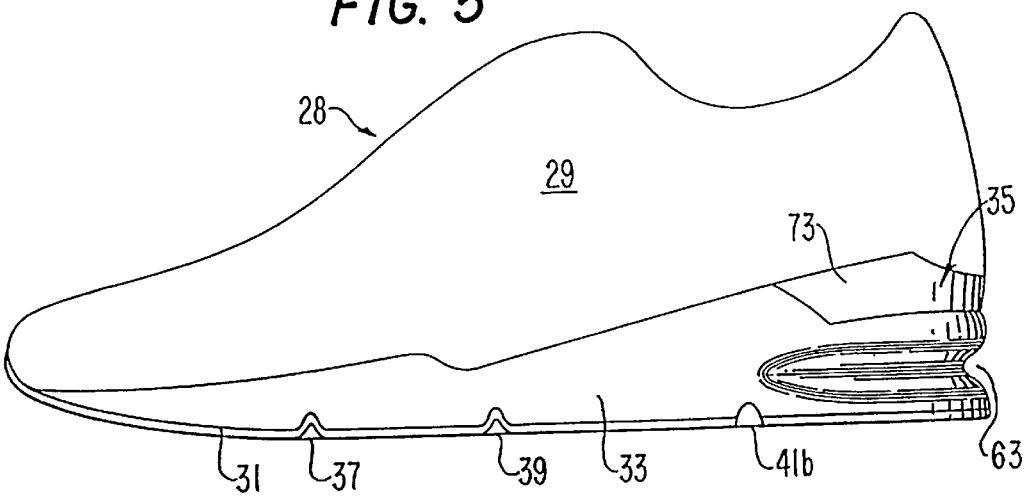
FIG. 5 is a lateral side view of the shoe shown in FIG. 4.

The rearfoot strike zone generally need only extend toward the medial side a short distance beyond the longitudinal center of the rear side of the heel in order to accommodate the heel strike of most runners. The medial side termination point of the rearfoot strike zone is conveniently described in relation to the weight bearing center of the heel, i.e., the nominal location of the apex of the plantar surface of the calcaneus, (labeled 23 in FIGS. 2 and 3). More specifically, the medial side termination point may be described in terms of the angle θ formed between a longitudinal center axis of the sole and a line drawn from the weight bearing center 23 of the heel to the termination point. Placement of the medial side termination point of the rearfoot strike zone so as to create an angle θ of 10° is satisfactory to accommodate the heel strike of many runners. The angle θ may be increased from 10° up to 50° for greater inclusiveness of the range of possible heel strikes. However, extension of a more compliant rearfoot strike zone in accordance with the present invention, beyond this point, will begin to degrade medial stability, particularly for those runners exhibiting a tendency towards over-pronation.

Again, "line of flexion" as used herein refers to a line of action, rather than a physical element of the sole per se, about which articulation of the rearfoot strike zone occurs. The location and path of line of flexion 21 are determined by physical elements of the sole (to be described hereinafter) that cooperate to provide a relatively independent articulation of the rearfoot strike zone relative to the remaining heel area. By delimiting the rearfoot strike zone with a relatively flexible border (a "line of flexion"), increased compliance within the strike zone is obtained since the strike zone is able to pivot as a whole in addition to compressing. In contrast, the cushioning action of a strike zone comprising a softer material but lacking a defined line of flexion may be compromised by resistance to bending of the sole associated with deflection of the strike zone. The provision of a line of flexion in accordance with the present invention allows the compliance of the rearfoot strike zone to be enhanced.

Line of flexion 21 is shown in FIG. 3 with its ends at the outer limits of the preferred ranges of the rearfoot strike zone, as described above. This location provides maximum inclusiveness of the range of possible heel strike locations without degrading lateral and medial stability. A first (medial) side end 25 of line 21 is located such that a line drawn from a nominal (average) location of the weight bearing center 23 of the heel to the first end 25 forms a 50° angle with respect to a central longitudinal axis of the sole. A second (lateral) side end 27 of line 21 is located adjacent to a nominal location of the junction 19 of the calcaneus 7 and cuboid 11. Although line of flexion 21 is shown to extend linearly between first and second ends 25, 27, and to intersect with heel center 23, this is not necessarily the case. Line of flexion 21 may be arcuate along part or all of its length, and may be moved rearwardly in accordance with the guidelines set forth above for delimiting the rearfoot zone. A generally linear path between ends 25 and 27 is preferred in order to provide effective articulation of the rearfoot strike zone at heel strike.

A first shoe embodiment 28 in accordance with the present invention is illustrated in FIGS. 4–9. The shoe comprises a conventional upper 29, and a sole attached to the upper. The sole comprises an outsole 31 of wear resistant material, a cushioning midsole 33, and a motion control element 35.

A plurality of flex joints are formed in the sole. In the forefoot region, a set of flex grooves 37, 39 extend transversely across the sole. Two aligned flex grooves 41*a*, 41*b* are provided in the rearfoot region, and it is along these flex grooves that line of flexion 21 is formed. In this embodiment, flex grooves 41*a*, 41*b* constitutes two features of the sole serving to define the path and location of line of flexion 21, and thereby delimit rearfoot strike zone 43.

The flex joints in the sole can be formed in a number of different ways. For instance, outsole 31 and midsole 33 may cooperatively form the flex joints as grooves having a V-shape in cross-section, as shown in FIGS. 4–8. Furthermore, all or some of the flex grooves may vary in depth along their lengths, as do flex grooves 41*a*, 41*b*. FIGS. 10–13 illustrate clearly various possible flex joint constructions.

Figure 10:
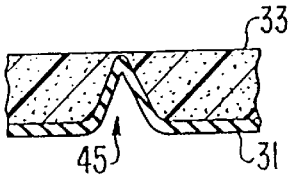
FIGS. 10–13 are partial cross-sectional views illustrating various alternative flex joint constructions.
Figure 11:
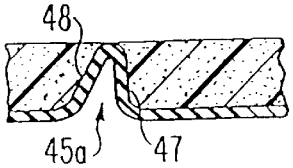
Figure 12:
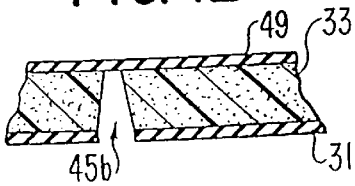
Figure 13:
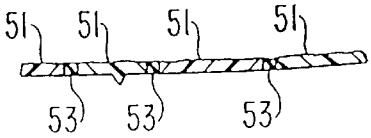

In FIG. 10, flex groove 45 has the V-shaped cross-section construction shown in FIGS. 4–8. Alternatively, the flex joints could be formed as grooves having other shapes, such as groove 45*a* shown in FIG. 11. According to this embodiment, groove 45*a* is defined by an upright wall 47 and an inclined wall 48. This type of groove may be useful if a greater freedom of movement is desired relative to the side of the groove adjacent inclined wall 47. The flex joints may also be formed as grooves 45*b* which are defined by simply removing or omitting a portion of the outsole 31 and midsole 33, as seen in FIG. 12. Grooves 45*b* could be left open or filled partially or wholly with a highly elastic and flexible material. As shown in FIGS. 10–12, the grooves may be deep troughs which extend substantially through the sole in order to provide maximum flexibility. In the embodiment of FIG. 12, layer 49 may be a textile material such as KEVLAR® adhered to the midsole and functioning as the insole or as a support for the insole. Further, the textile material can comprise an elastic material.

Additionally, the flex joints may be formed by providing a weakened construction or a material of greater elasticity and flexibility. One example of this type of construction is disclosed in co-pending commonly owned application Ser. No. 07/986,046 to Lyden et al., entitled CHEMICAL BONDING OF RUBBER TO PLASTIC IN ARTICLES OF FOOTWEAR (incorporated by reference herein). According to this construction at least a portion of the sole would be formed by a mosaic of plastic plates 51 bound together by a rubber material 53. The location of the rubber would correspond to the flex joints. Alternatively, a strip of relatively flexible material could be incorporated into a midsole having a conventional outsole attached thereto.

Figure 6:
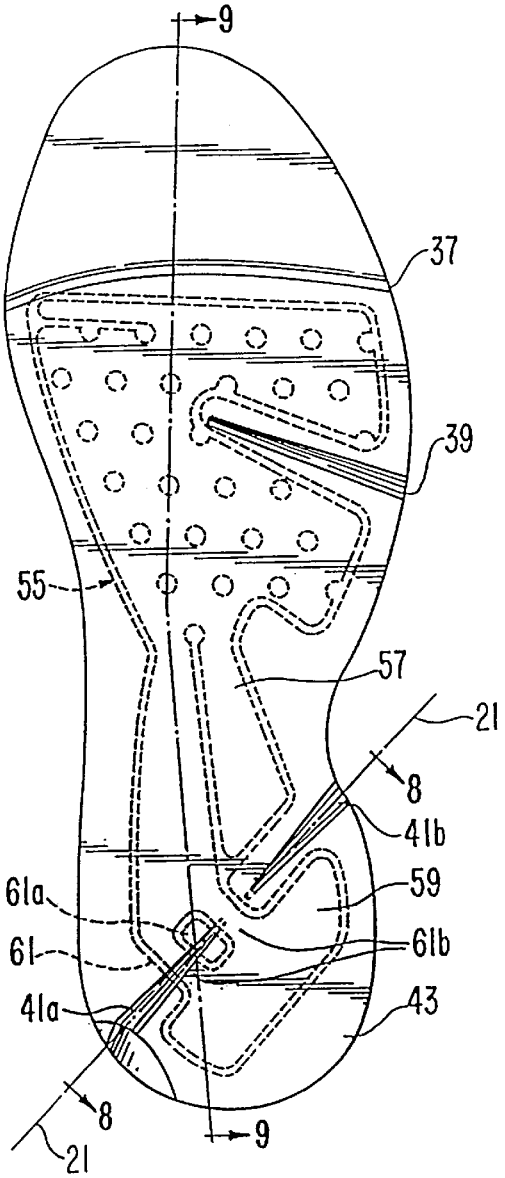
FIG. 6 is a bottom plan view of the sole of the shoe shown in FIG. 4, illustrating in phantom a segmented resilient fluid bladder in accordance with the present invention.
Figure 7:
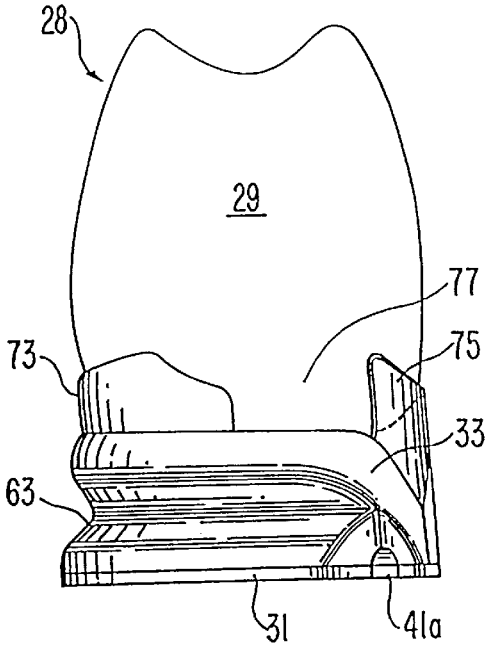
FIG. 7 is a rear elevational view of the shoe shown in FIG. 4.
Figure 8:
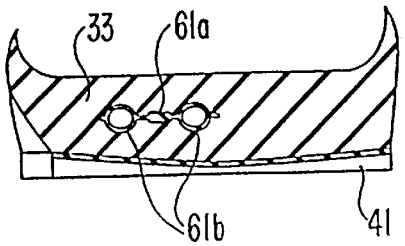
FIG. 8 is a cross-sectional view taken on section line 8—8 in FIG. 6.
Figure 9:
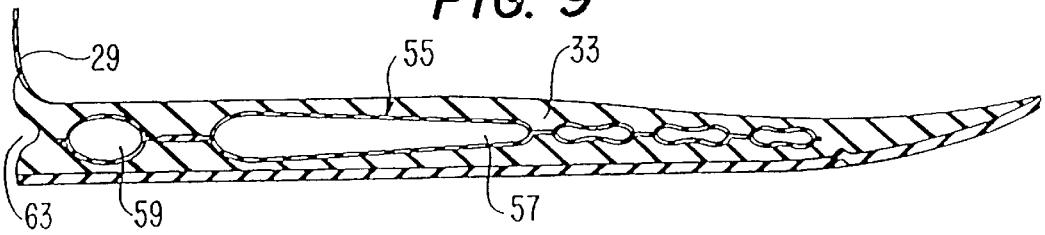
FIG. 9 is a cross-section view taken on section line 9—9 in FIG. 6.

Referring now to FIGS. 6, 8 and 9, midsole 33 is formed of a cushioning, resilient foam material such as polyurethane foam and has encapsulated therein a segmented resilient gas-filled bladder 55. Bladder 55 is preferably generally formed in accordance with the teachings of the Rudy patents mentioned in the background section and incorporated herein by reference.

Bladder 55 has a large chamber 57 extending from the forefoot region of the sole to the rearfoot area outside of rearfoot strike zone 43. A second smaller chamber 59 of bladder 55 is located within rearfoot strike zone 43 and comprisesa major part (more than half) of the midsole portion therein. Chambers 57 and 59 are connected and articulated with respect to each other through a relatively flexible bladder portion 61 acting as a hinge. As shown, flexible bladder portion 61 comprises a weld seam 61*a* and a pair of passageways 61*b* placing chambers 57 and 59 in fluid communication with each other. Flexible bladder portion 61 is aligned with flex grooves 41*a*, 41*b*, such that these elements cooperate with each other to locate line of flexion 21 therealong. In this manner, rearfoot strike zone 43 is delimited by line of flexion 21 and articulated in relation to the remaining heel area.

The provision of a line of flexion 21, in accordance with the present invention, affords a greater compliance to rearfoot strike zone 43, whereby the surface area of initial ground engagement is increased. Furthermore, cushioning is enhanced in the rearfoot strike zone by decreasing the compressive stiffness of midsole 33 within rearfoot strike zone 43. This can be accomplished in one or more of several different ways. In the embodiment of FIGS. 4–9, midsole 33 is formed with a concave sidewall channel 63 extending along rearfoot strike zone 43. By omitting a significant amount of midsole material from along the edge of rearfoot strike zone 43, the compressive stiffness of the rearfoot strike zone 43 is decreased relative to the remaining heel area.

Alternatively, instead of placing chambers 57 and 59 in fluid communication with each other and hence at equal inflation pressures, chambers 57 and 59 could be fluidically isolated from each other, e.g., by extending weld 61*a* across the areas of fluid passageways 61*b*. Chamber 59 could then be inflated to a lower pressure than chamber 57 in order to provide less compressive stiffness of midsole 33 within rearfoot strike zone 43.

Figure 14:
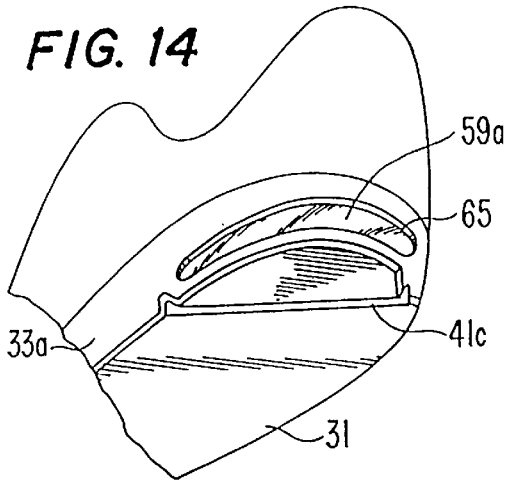
FIG. 14 is a partial perspective view of the rearfoot area of a shoe, illustrating alternative features of the present invention.

The invention is by no means limited to the illustrated configuration of segmented bladder 55. For example, bladder chamber 59 could be modified to comprise a smaller or larger part of midsole 33 within rearfoot strike zone 43. As shown in FIG. 14, a modified bladder chamber 59*a* could be configured to cooperate with a gap 65 in the sidewall of a midsole 33*a* to form a viscoelastic unit. In such a configuration, bladder chamber 59*a* would flex into gap 65 during rearfoot strike, such that the compressive stiffness of chamber 59*a* would be decreased. In this view, a modified flex joint 41*c* comprises a single continuous groove.

Figure 15:
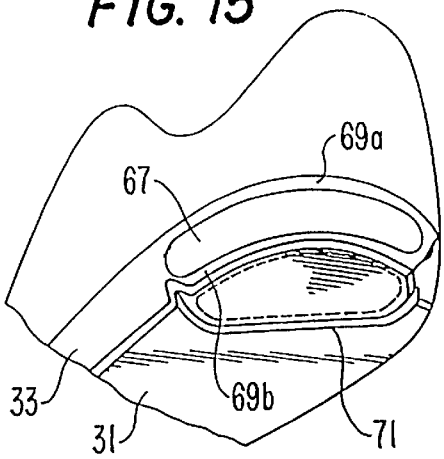
FIG. 15 is a partial perspective view of the rearfoot area of a shoe, illustrating further alternative features in accordance with the present invention.
Figure 16:
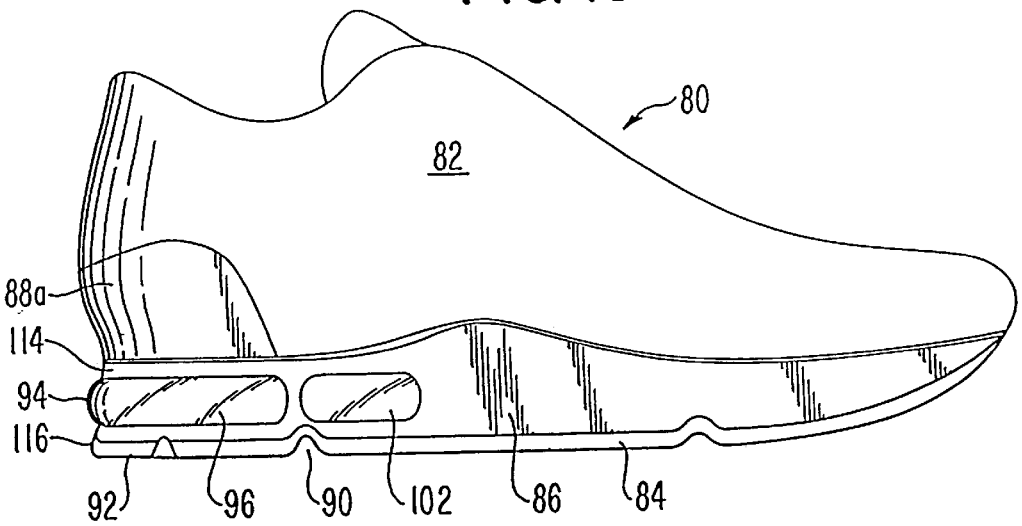
FIG. 16 is a lateral side view of a shoe illustrating another embodiment of the present invention.
Figure 17:
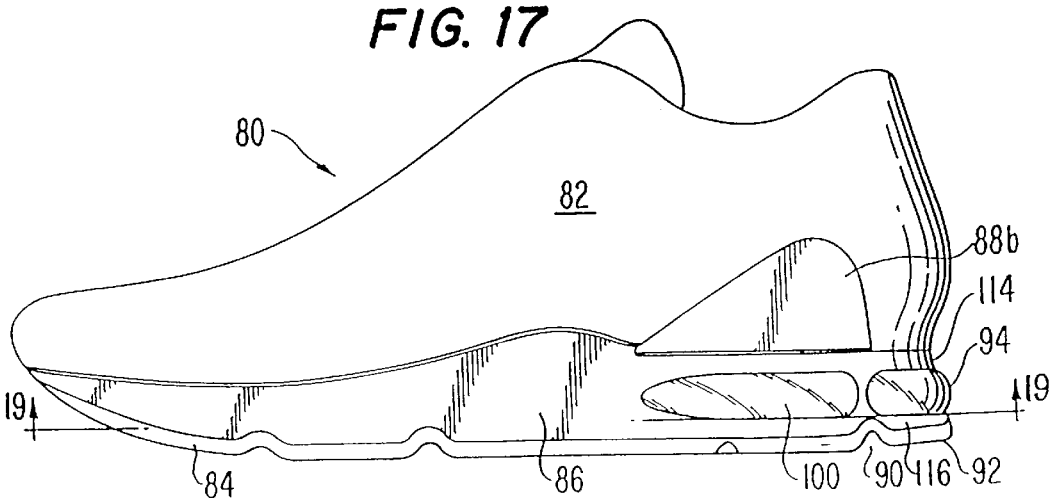
FIG. 17 is a medial side view of the shoe shown in FIG. 16.

Bladder chamber 59 could be provided entirely separate from bladder chamber 57, or bladder chamber 57 could be omitted entirely. The latter variation is illustrated in FIG. 15. In this embodiment, a single fluid bladder 67, which may be a single chamber or multi-chamber bladder, comprises almost the entire portion of midsole 33 within the rearfoot strike zone. As shown, thin layers 69*a*, 69*b* of midsole material, e.g., plastic foam, encapsulate the upper and lower surfaces of bladder 67. A sidewall portion of bladder 67 is substantially wholly exposed between the first and second ends of the arcuate line of flexion defined by arcuate groove 71. In this manner, the sidewall of bladder 67 forms a flexible sidewall of midsole 33 within the rearfoot strike zone.

In a further possible modification, thin layers 69*a*, 69*b* could be omitted and bladder 67 bonded directly to the shoe upper or insole and outsole 31. Furthermore, in this embodiment it would be desirable to provide a relatively flexible juncture between bladder chamber 67 and the adjoining midsole material within the remaining heel area. Such a juncture might, for example, be formed by a line of highly elastic and flexible midsole material.

The preferred embodiment of FIGS. 4–9 integrates with articulated rearfoot strike zone 43 a motion control device 35 comprising a heel support member (heel counter) having lateral and medial segments 73, 75. Motion control device 35 is preferably formed of a relatively rigid and incompressible plastic material. Heel counter segments 73, 75 extend upwardly coextensive with a portion of upper 29 in the heel area, on lateral and medial sides thereof. Lateral segment 73 extends rearwardly to the center of the heel. On the other hand, medial segment 75 terminates just above the medial side end of flex groove 41*a*, such that a vertical line passing through the end of groove 41*a* (and line of flexion 21 coincident therewith) passes through or adjacent to a gap 77 formed between segments 73, 75. Whereas a single piece rigid heel counter extending about the back of the heel area could tend to rigidify the heel area and impede independent articulation of rearfoot strike zone 43, the provision of a split heel counter in accordance with the present invention allows articulation of rearfoot strike zone 43 to go unimpeded. At the same time, the benefits of stability that a heel counter can provide may be realized.

In the illustrated preferred embodiment, medial counter segment 75 is formed integrally with a rearfoot motion control device 78 (see FIG. 4) of the same general type as is disclosed in the Kilgore et al. patent mentioned in the background section and incorporated by reference herein. Similar to the Kilgore et al. device, motion control device 78 comprises two generally vertically extending rigid supports 78*a*, 78*b* affixed to midsole 33. Extending between supports 78*a*, 78*b* along the top medial edge of midsole 33 is a common base (not shown) providing a cantilever support for a plurality of plate-like finger elements (not shown) extending horizontally across the footbed. Motion control device 78 is configured in accordance with the teachings of Kilgore et al. in order to gradually increase the resistance to compression of the midsole from the lateral side to a maximum along the medial side, to thereby control rearfoot pronation. Motion control device 78 should be located entirely outside of rearfoot strike zone 43 so that the articulation of and cushioning within the rearfoot strike zone remains unaffected.

A further embodiment of the invention is illustrated in FIGS. 16–20. Like the shoe of FIGS. 1–9, shoe 80 comprises a conventional upper 82, and a sole attached to the upper. The sole comprises an outsole 84 of wear resistant material, a cushioning midsole 86, and a split heel counter having lateral and medial segments 88*a*, 88*b*.

A plurality of flex grooves are formed in the sole, including a groove 90 extending across the sole in the heel area and serving to define a line of flexion 21' (see FIG. 20) delimiting an articulated rearfoot strike zone 92. These flex joints may take any of the forms previously described. The medial and lateral limits of rearfoot strike zone 92 are within the range of preferred limits previously described. The split of the heel counter is coordinated with the line of flexion 21' in accordance with the description of the first embodiment, so as not to impede the articulation of rearfoot strike zone 92.

Midsole 86 encapsulates within the rearfoot area a segmented resilient gas-filled bladder 94 having a plurality of chambers which may exhibit different stiffnesses. More specifically, referring to FIGS. 19 and 20, bladder 94 comprises a first chamber 96 located within the rearfoot strike zone 92, a second chamber 98 extending within a central portion of the remaining heel area, about a nominal location of the weight bearing center of the heel, a third chamber 100 extending along a medial side portion of the remaining heel area, and a fourth bladder chamber 102 extending along a lateral side of the remaining heel area.

Chambers 96–102 are shown connected to each other by a relatively flexible web portion 104 extending therebetween. Such a web may be formed integrally with the chambers by blow-molding. Alternatively, bladder 94 may be formed by welding the appropriate divisions between the chambers using a conventional technique.

Figure 20:
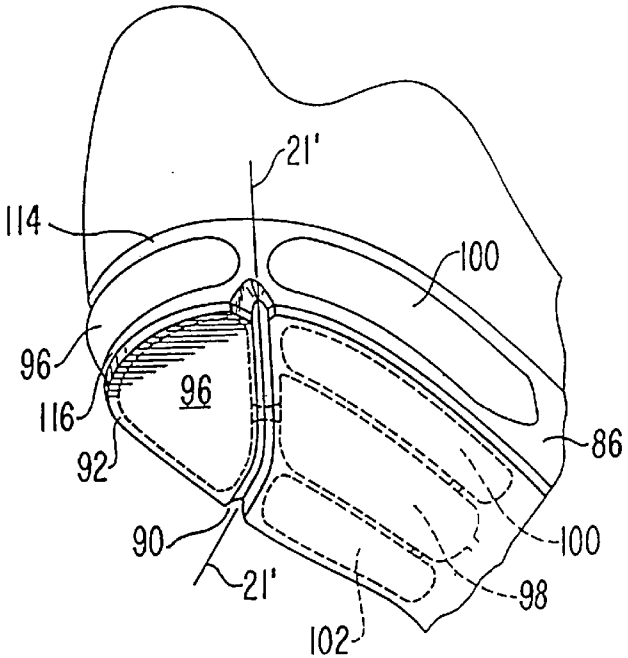
FIG. 20 is a partial perspective view of the rearfoot area of the shoe shown in FIG. 16.
Figure 19:
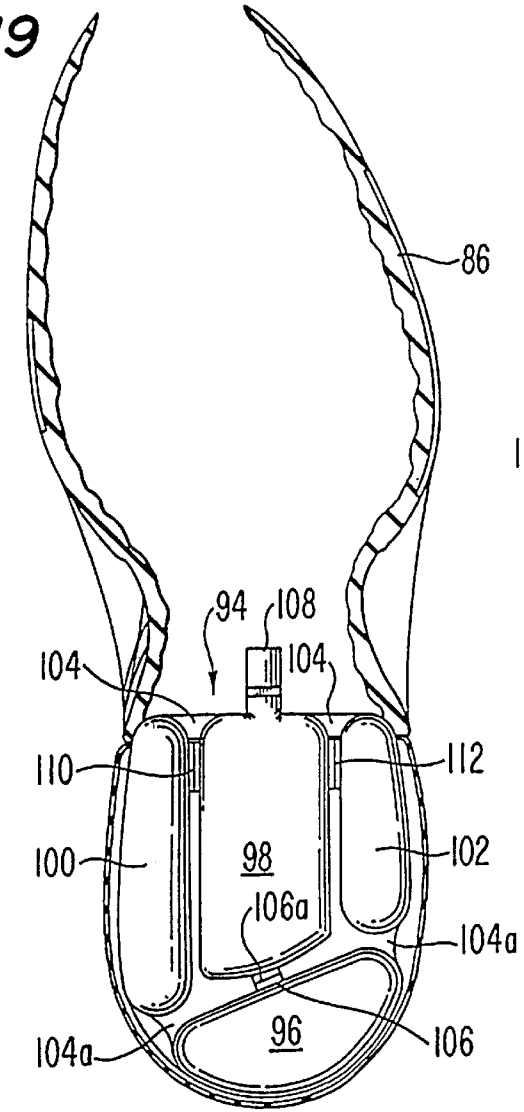
FIG. 19 is a cross-sectional view taken on line 19—19 in FIG. 17.
Figure 18:
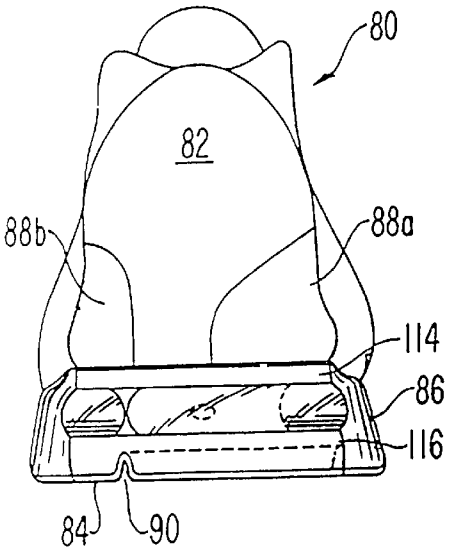
FIG. 18 is a rear elevational view of the shoe shown in FIG. 16.

A flexible joint is not necessary between bladder chambers 98, 100 and 102. It is however advantageous to provide a relatively flexible joint between first bladder chamber 96 and the other chambers so as to allow unimpeded articulation of rearfoot strike zone 92 relative to the remaining heel area. In this embodiment, the relatively flexible bladder portion 104*a* connecting bladder 96 to the other chambers, and flex groove 90 aligned therewith, cooperate to determine the path and location of line of flexion 21'. As best seen in FIG. 20, line of flexion 21' is arcuate along a portion of its length, so as to accommodate the rounded medial corners of chambers 96 and 102.

Flexible web 104*a* need not extend the entire length from the medial to lateral side along chamber 96. For increased flexibility, it may be desirable to remove or omit portions of web 104*a*, e.g., leaving chamber 96 connected only to central chamber 98. Furthermore, a void in the encapsulating midsole material may be provided along web 104*a* for increasing flexibility and to avoid localized stiffness in compression.

Fluid bladder 94 advantageously allows differential inflation pressures and hence stiffnesses to be provided in different parts of the rearfoot area, so that the cushioning characteristics of the heel can be optimized. In accordance with the present invention, the medial and lateral side chambers 100, 102 are preferably inflated to a pressure of between 15 and 50 psi, and most preferably between 20 and 25 psi. Chamber 96 in the rearfoot strike zone is preferably inflated to a pressure of between 1 and 10 psi, and most preferably between 1 and 5 psi. Tests have indicated that with the medial side chamber 100 inflated to 25 psi and rearfoot strike zone chamber 96 inflated to 5 psi, chamber 96 will exhibit roughly half of the compressive stiffness of chamber 100.

The compressive stiffness of the central rearfoot area is preferably also lowered in relation to the stiffness on the lateral and medial sides. This can provide enhanced cushioning without adversely affecting lateral and medial stability. Accordingly, it is preferable to inflate central chamber 98 to a pressure of between 1 and 10 psi, and most preferably between 1 and 5 psi. In order to maintain chambers 98 and 96 at equal pressures, these chambers can be kept in fluid communication through a passageway 106 extending through flexible web 104*a*. Alternatively, passageway 106 can be sealed off by a weld line 106*a* to isolate chambers 96 and 98, in which case the pressure in chamber 96 could be made lower or higher.

The manner of inflating bladder 94 is now briefly described. The entire bladder is inflated through flexible stem 108, with all of the chambers initially in fluid communication with each other. Fluid communication between chambers 96 and 98 is provided through passageway 106 as previously described. Similar fluid passageways 110 and 112 connect chambers 98, 100 and 102.

Initially, the entire bladder 94 is inflated to the maximum desired chamber pressure. Then the chamber(s) in which it is desired to maintain the maximum pressure, e.g., medial side chamber 100 and lateral side chamber 102, are sealed off by welding across the appropriate fluid passageways. Then, pressure can be bled through stem 108 until the desired lower pressures are obtained in the remaining chambers. Next, these chambers are sealed in a similar manner, with the final weld being placed across stem 108 to seal chamber 98.

The basic concept of segmented bladder 94 can be applied equally to segmented bladders of various configurations. For example, the number of separate bladder chambers and the shapes and sizes thereof may be varied. In particular, if it is desired to adjust the line of flexion 21' within the preferred range described herein, the bladder configuration can be changed accordingly. Furthermore, bladder 94 need not be restricted to the rearfoot area but may extend into portions of the midfoot and forefoot regions. Conversely, the bladder chambers could occupy a lesser portion of the rearfoot strike zone and remaining heel area.

In the particular embodiment illustrated in FIGS. 16–20 relatively thin layers 114, 116 of midsole material encapsulate the upper and lower surfaces of bladder 94. The side wall portions of bladder 94 are thus substantially wholly exposed to form a flexible generally transparent sidewall along the medial, rear and lateral sides of the midsole rendering at least a portion of the internal structure of the sole visible. Alternatively, bladder 94 could be wholly encapsulated or bonded directly between the upper or insole and the outsole without encapsulating layers.

Furthermore it can be readily understood that any resilient gas filled bladder utilized in the practice of the invention may be stock-fit rather than encapsulated.

Figure 23:
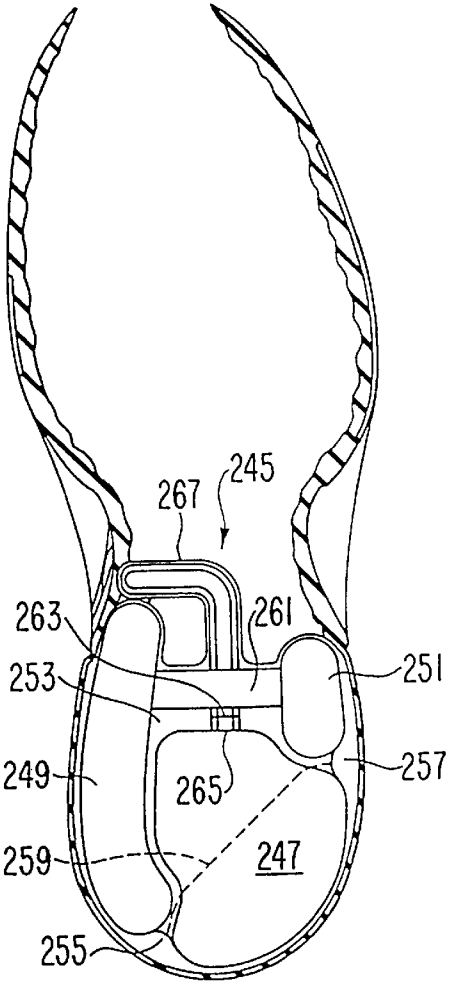
FIGS. 21–23 are cross-sectional views along the transverse plane, similar to that shown in FIG. 19, showing in plan alternative blow-molded multi-chamber fluid bladder configurations in accordance with the present invention.
Figure 22:
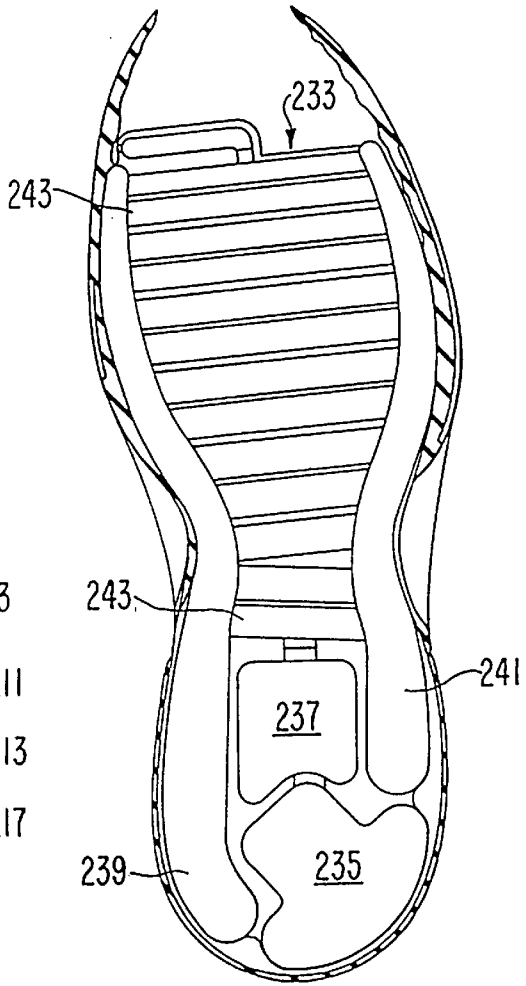
Figure 21:
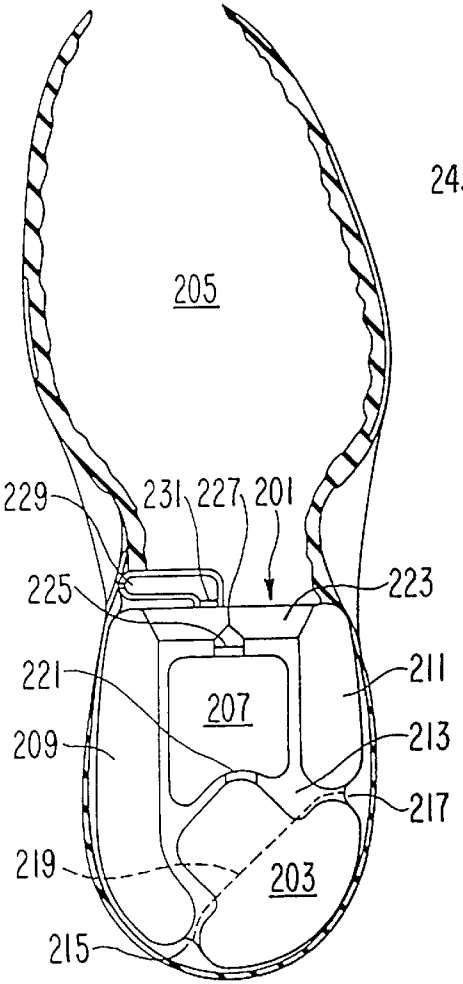

Further embodiments of the invention are now described with reference to FIGS. 21–29. Referring first to FIGS. 21–23, illustrated are variously shaped multi-chamber blow-molded resilient fluid bladder embodiments of the invention. As in the blow-molded bladder embodiment shown clearly in FIG. 19, each of the bladders of FIGS. 21–23 is configured to provide a lesser compressive stiffness in a rearfoot strike zone relative to the compressive stiffness along at least a medial side of the remaining heel area. This is achieved in each embodiment by the provision of separate bladder chambers having different volumes and/or fluid pressures. Additionally, the bladders are configured and segmented so as to create in the sole a line of flexion, i.e., a line of action as previously discussed, that allows the rearfoot strike zone to articulate in relation to the remaining heel area.

In particular, referring to FIG. 21, a blow-molded fluid bladder 201 comprises a first generally arrow-head shaped chamber 203 pointing toward the rear lateral corner of sole 205, a second chamber 207 extending within a forward central region of the heel area, a third chamber 209 extending along a medial side portion of the heel area, and a fourth bladder chamber 211 extending along a forward lateral side portion of the heel area. The first through fourth chambers are connected to each other by a relatively flexible web portion 213 extending therebetween. As in the embodiment of FIG. 19, web 213 may be formed integrally with the chambers during the blow-molding process.

Relatively flexible web portion 213 extends about the perimeter of first bladder chamber 203, between a first end 215 located along a rear medial side of sole 205 to a second end 217 located along a lateral side of the sole. Due to the shape, size and location of bladder chamber 203, web portion 213 does not, as in the embodiment of FIG. 19, serve to create a line of flexion wholly coincident with web portion 213. Rather, the relatively high flexibility of web portion 213 proximal the first and second ends 215, 217, and relatively low compressive stiffness of resilient bladder chamber 203, generally serve to define a line of flexion as depicted by dotted line 219. Line 219 extends generally across chamber 203 between first and second end points 215, 217, to thereby delimit a rearfoot strike zone which is substantially occupied by the rearward relatively wide portion of chamber 203.

As has been previously discussed in connection with the earlier embodiments, one way to enhance articulation of the rearfoot strike zone about the line of flexion is to provide one or more grooves in the outsole and/or midsole, extending along all or part of the line of flexion. Such registered grooves may not be necessary, however, since the flexibility of the sole can be increased along line 219 due to the configuration of chamber 203 and relatively flexible web portion 213.

In accordance with the principles of the invention, second end 217 of the relatively flexible web path (and thus line of flexion 219) should be adjacent to or rearward of a nominal location of the junction of the calcaneus and cuboid bones of the foot. The first end 215 should be located such that a line drawn from a nominal location of the weight bearing center of the heel to the first end forms approximately a 10° to 50° angle with respect to the central longitudinal axis of the sole.

To achieve a lesser relative compressive stiffness in the rearfoot strike zone, chamber 203 can be sealed at ambient pressure, or with an inflation pressure of up to approximately 5 psi (references to psi herein are to gage pressures). The second bladder chamber 207 is preferably (although not necessarily) maintained at the same low pressure (and relative compressive stiffness) as first chamber 203. This can be accomplished by providing the first and second chambers in fluid communication with each other through a connecting passageway 221. Alternatively, the first and second chambers can be sealed-off from each other by placing a weld line across passageway 221. On the other hand, third chamber 209 extending along the medial side of the heel area should be inflated to a higher pressure of generally between 20 and 25 psi. As illustrated, fourth chamber 211 extending along a forward lateral side of the heel area can also be maintained at between 20 to 25 psi by virtue of the fluid communication between the third and fourth chambers provided by a connecting (and cushioning) passage 223. Alternatively, third chamber 209 and fourth chamber 211 can be fluidically isolated from each other so as to create smaller effective chamber volumes. This will increase compressive stiffness, as explained below in connection with the FIG. 22 embodiment. The first and second chambers 203, 207 are sealed-off from the third and fourth chambers 209, 211, and connecting passageway 223, by a weld line 225 placed across a third passageway extending between the second chamber 207 and passageway 223.

An inflation nozzle (stem) 229 is provided in fluid communication with passageway 223. The general procedure for filling and sequentially sealing the respective bladder chambers in order to obtain different inflation pressures therein has previously been described in connection with the FIG. 19 embodiment, and is taught in U.S. Pat. No. 5,353,459 issued to the present assignee. (This patent is hereby incorporated by reference in its entirety.) Following the inflation and placement of a final weld line 231 across stem 229, the terminal end portion of stem 229 can be removed.

Referring now to FIG. 22, illustrated is an embodiment employing a substantially full-length blow-molded multi-chamber resilient bladder 233. The configuration of the heel portion of bladder 233 is substantially the same as bladder 201 shown in FIG. 21. First and second chambers 235, 237 correspond identically to first and second chambers 203, 207 in the FIG. 21 embodiment. Third and fourth chambers 239, 241 are configured to have within the rearfoot area the same general shape and location as chambers 209, 211 of the FIG. 21 embodiment. However, chambers 239, 241 do not terminate in the rearfoot area. Rather, each extends all the way up into the forefoot area of the sole, tapering along its length.

A plurality of adjacent tubular passageways 243 (only foremost and rearmost labelled) extend transversely between chambers 239 and 241. Passageways 243 serve as fluid cushioning members and also to place the third and fourth chambers 239, 241 in fluid communication with each other.

In the FIG. 22 embodiment, the compressive stiffness of third and fourth chambers 239, 241 is reduced for a given inflation pressure, relative to that of third and fourth chambers 209, 211 of the FIG. 21 embodiment, due to a substantially greater effective chamber volume. From Boyle's law (PV=nRT), it is known that as the volume of a sealed bladder chamber is decreased, e.g., due to compression, pressure (and hence compressive stiffness) increases. Ground contact will generally cause a bladder chamber of relatively large size to undergo a volume decrease (due to compression) that is relatively small in proportion to the original chamber volume. On the other hand, for the same ground contact, a bladder chamber of relatively small volume undergoes a much greater proportional volume decrease. As a result, the pressure in the smaller bladder chamber rises much more quickly resulting in greater relative compressive stiffness. Thus, it can be readily understood that in order to obtain the same overall compressive stiffness of third and fourth chambers 239, 241 of bladder 233 as is achieved in the corresponding chambers 209, 211 of bladder 201, it is necessary to inflate the former chambers to higher pressures. Alternatively, weld lines could be used to fluidically isolate various portions of chambers 239, 241 and passageways 243 from each other, in order to reduce the effective chamber volumes and hence increase compressive stiffnesses for given inflation pressures.

Referring now to FIG. 23, a further variation is shown. A blow-molded multi-chamber bladder 245 generally located in the rearfoot area has a relatively large first chamber 247. Chamber 247 is nested between a medial side chamber 249 extending along substantially the entire medial side of the rearfoot area, and a relatively small lateral side chamber 251. In this embodiment, a relatively flexible connecting web portion 253 extends about the perimeter of first bladder chamber 247, between a first end 255 located along a rear medial side of the sole and a second end 257 located along a lateral side of the sole. (The first and second ends are located in accordance with the previously stated criteria.) Similar to the FIG. 21 embodiment, the configuration of chamber 247 and the relatively flexible connecting web portion 253 proximal the first and second end points 255, 257 serves to create a line of flexion (depicted by dotted line 259) extending between first and second end points 255, 257, and across chamber 247. Line 259 delimits a rearfoot strike zone that is substantially occupied by a rearward relatively wide portion of chamber 247.

To achieve a lesser relative compressive stiffness in the rearfoot strike zone, first chamber 247 can be sealed at ambient pressure, or with an inflation pressure of up to approximately 5 psi. On the other hand, medial side chamber 249 can be inflated to a higher pressure of between 20 and 25 psi. As illustrated, lateral side chamber 251 is also maintained at between 20 to 25 psi, by virtue of the fluid communication between chambers 249 and 251 provided by connecting passage 261 (which can also serve as a cushioning element). First chamber 247 is sealed-off from chambers 249, 251, and connecting passageway 261, by a weld line 263 placed across a second passageway 265 extending between chamber 247 and passageway 261. An inflation nozzle (stem) 267 is provided in fluid communication with passageway 261.

Although not illustrated, it should be understood that the chambers 203, 235 and 247 of the bladders illustrated in FIGS. 21–23 may incorporate further features designed to provide dimensional stability thereto. For example, weld lines or weld dots connecting the opposite sides of the bladder chambers can be used to prevent ballooning of the bladder or to maintain generally planar top and bottom bladder surfaces. However, since such features tend to increase compressive stiffness in localized areas, particularly if the voids formed thereby are filled with encapsulating foam material, it is generally advisable that these features be used sparingly in the rearfoot strike zone.

Referring now to FIGS. 24–29, illustrated are embodiments employing the fluid bladder technology specifically described in Rudy U.S. Pat. Nos. 4,906,502 and 5,083,361 (which are hereby incorporated by reference in their entirety). Products embodying such technology are marketed by the present assignee under the trademark TENSILE AIR®. Bladders in accordance with these patents employ a resilient fluid-filled chamber having an internal three-dimensional (3-D) fabric therein. The fabric is bonded to the upper and lower internal walls of the chamber envelope and serves as a tensile strength member for maintaining the upper and lower walls as smooth substantially planar surfaces, even when the bladder chambers are inflated to relatively high pressures. At the same time, the three dimensional fabric offers no significant resistance to compression.

Figure 24:
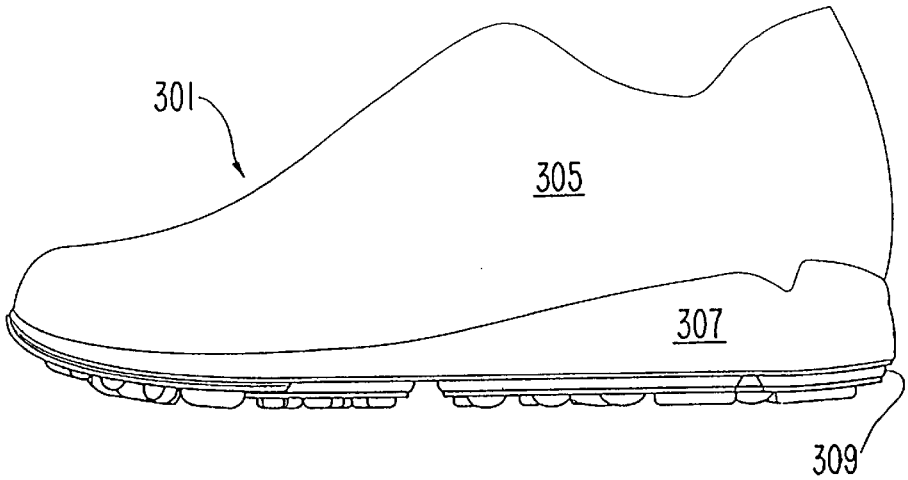
FIG. 24 is a lateral side elevational view of an alternative shoe embodiment of the invention, including multiple outsole segments bonded directly to a multi-chamber fluid bladder including tensile fabric members.
Figure 25:
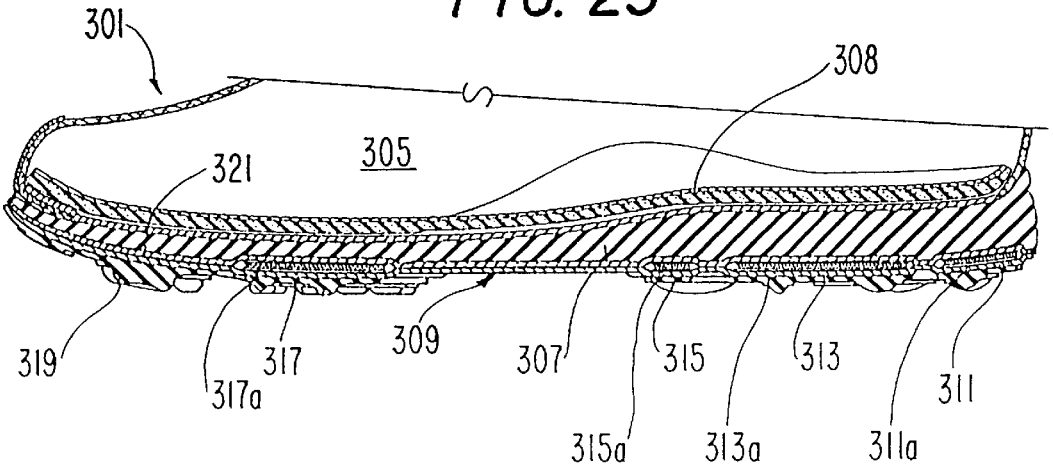
FIG. 25 is a longitudinal cross-sectional view of the shoe shown in FIG. 24, taken on line 25—25 of FIG. 26, showing the internal structure of the bladder chambers, including the tensile fabric members.
Figure 27:
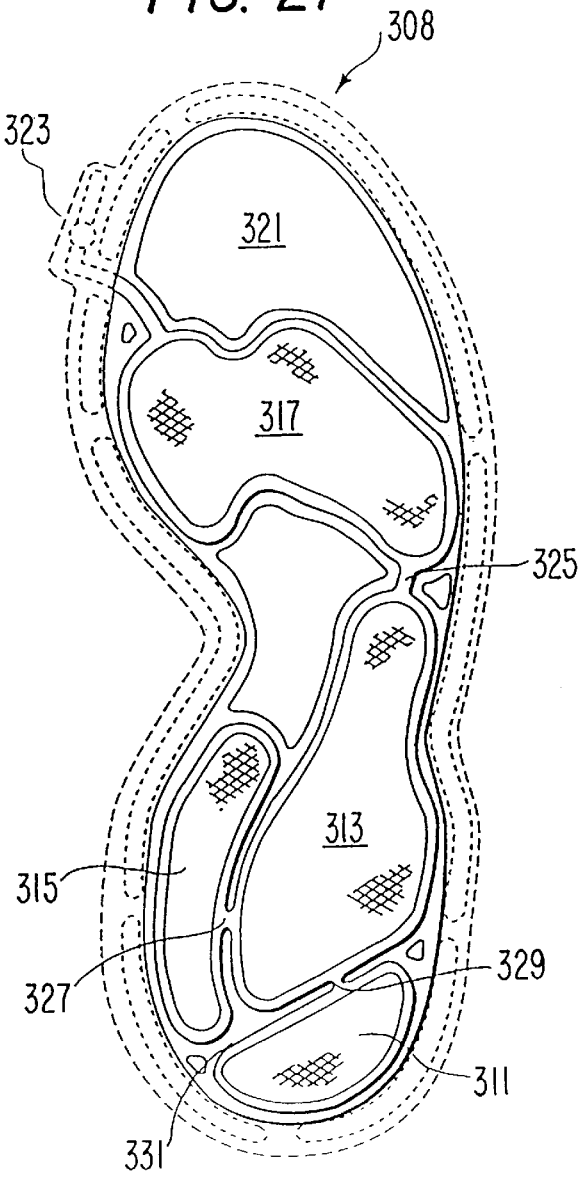
FIG. 27 is a bottom plan view of the multi-chamber fluid bladder included in the sole the shoe shown in FIGS. 24–26.

As seen in FIGS. 24 and 25, a shoe 301 comprises an upper 305 of conventional construction. The bottom of upper 305 is secured in a conventional fashion to a cushioning midsole 307 formed of foamed resilient plastic, e.g., EVA. Within upper 305 is an insole 308. A multi-chamber fluid bladder 309 is affixed or bonded (such as by adhesive) directly to the bottom of midsole 307. Bladder 309 extends coextensively with midsole 307 (as best seen in FIG. 27) and has a relatively thin profile (as best seen in FIG. 25). Like bladders can be formed with thicker profiles, i.e., increased height, as a matter of design choice. Stacked bladder chambers as taught in the '361 Rudy patent can also be utilized. Bladder 309 is formed in accordance with the teachings of the aforementioned '502 and '361 Rudy patents, such that each sealed bladder chamber (four total in the illustrated embodiment: 311, 313, 315 and 317) contains therein, and has bonded to the upper and lower walls thereof, a tensile strength member (311*a*, 313*a*, 315*a* and 317*a*) formed of a 3-D fabric.

In a preferred embodiment, bladder 309 is constructed from pieces of knit nylon 3-D fabric, urethane hot melt film layers, and a pair of urethane barrier film layers. The 3-D fabric has a pair of spaced fabric layers joined to one another by a plurality of threads referred to as drop threads. The barrier film layers are secured to the outwardly facing surfaces of the spaced fabric layers. The hot melt film is interposed between the two layers of the barrier film and the 3-D fabric, and functions as an adhesive to help secure the barrier film to the upper and lower surfaces of the fabric. The top and bottom barrier layers are welded to one another around a peripheral edge, and contact of the welded peripheral edge with sides of the fabric is avoided. The assembled bladder 309 is pressurized with a gas via inflation stem 323, and passageways 325, 327 and 329 placing the chambers in fluid communication with each other. The pressurized gas exerts an outward expansion force on the barrier film within each chamber, and the spaced fabric layers attached to the barrier film. This places the drop threads of the 3-D fabric pieces under tension. The 3-D fabric thus functions as a tensile restraining (strength) member which holds the barrier film layers in a spaced apart substantially planar relationship.

After the two layers of urethane barrier film are welded to one another around a peripheral edge, a flat peripheral edge piece (shown in dotted lines in FIG. 27) is created. This edge piece can be left on or, as in the illustrated embodiment of FIGS. 24–26, be trimmed off, so that the bladder fits neatly within the margins of the shoe sole.

Figure 26:
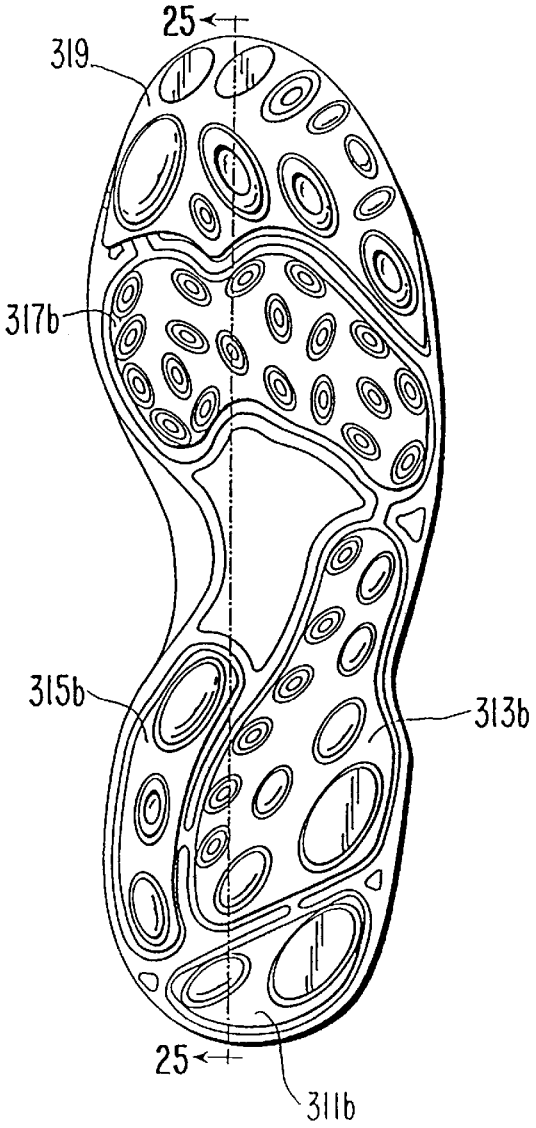
FIG. 26 is a bottom plan view of the shoe shown in FIGS. 24–25.

The outsole comprises multiple segments that are bonded directly to the bottom of bladder 309 at selected locations. In particular, as best seen in FIG. 26, rubber (or like material) outsole segments 311*b*, 313*b*, 315*b* and 317*b* are bonded (such as by adhesive) to each of the variously shaped bladder chambers. The outsole segment shapes correspond to the shapes of the underlying bladder chambers. An additional outsole segment 319 is bonded to the flat web portion 321 of bladder 309 located at the forefoot area. As illustrated, the cleats of this segment can be thicker than the cleats of the other outsole segments in order to compensate for the height differential introduced by the gas-filled bladder chambers.

The remaining interstitial bottom surfaces of bladder 309 can be uncovered and recessed relative to the bottom surfaces of the outsole segments. In this manner, divisions are formed between the respective outsole segments (and the bladder chambers associated therewith). These divisions can provide lines of relatively high flexibility, i.e., lines of flexion. Employing the principles of the invention, chamber 311 is separated from chambers 315 and 313 by a division 331. Division 331 forms a line flexion delimiting a rearfoot strike zone. In this embodiment, chamber 311 is wholly contained within and occupies a substantial part of the rearfoot strike zone. Bladder chamber 311 preferably exhibits a lesser degree of compressive stiffness than bladder chamber 315 extending along a medial side portion of the heel.

Nested between bladder chambers 311, 315 is bladder chamber 313 extending within central and lateral heel areas and also within a lateral mid-foot region of the shoe. Preferably, the compressive stiffness of chamber 311 is reduced with respect to chamber 313 as well. Bladder chamber 317 extends from the lateral side to the medial side of the sole in the forefoot area (and generally corresponds to the ball of the foot) in order to provide cushioning to that region.

The procedure for inflating bladder chambers 311, 313, 315, 317 with gas is substantially the same as for the multi-chamber blow-molded bladders shown in FIGS. 21–23. Namely, with reference to FIG. 27, all of the chambers are initially provided in fluid communication with each other through connecting passageways 325, 327, 329. This allows all of the chambers to be simultaneously inflated to the same pressure through inflation stem 323. Then, differential pressures can be obtained by selectively adding and bleeding-off gas from the respective chambers, and sealing the chambers from each other by placing weld lines across the connecting passageways. For example, in order to provide a reduced gas pressure (and hence compressive stiffness) in chamber 311, as compared to the remaining chambers, all of the chambers are initially inflated to the desired pressure of first chamber 311 (e.g., 0–20 psi). Next, chamber 311 is sealed-off by placing a weld line across passageway 329 connecting chamber 311 to third chamber 313. The remaining chambers can then be inflated to a higher pressure (e.g., 10–30 psi) and sealed off in a similar manner, with a final weld line being placed across a base portion of stem 323. As an alternative to providing a lesser fluid pressure in chamber 311, it will be understood that the respective chamber volumes of bladder 308 could be varied in order to provide a lesser compressive stiffness in the rearfoot strike zone relative to at least a medial side portion of the remaining heel area.

Figure 28:
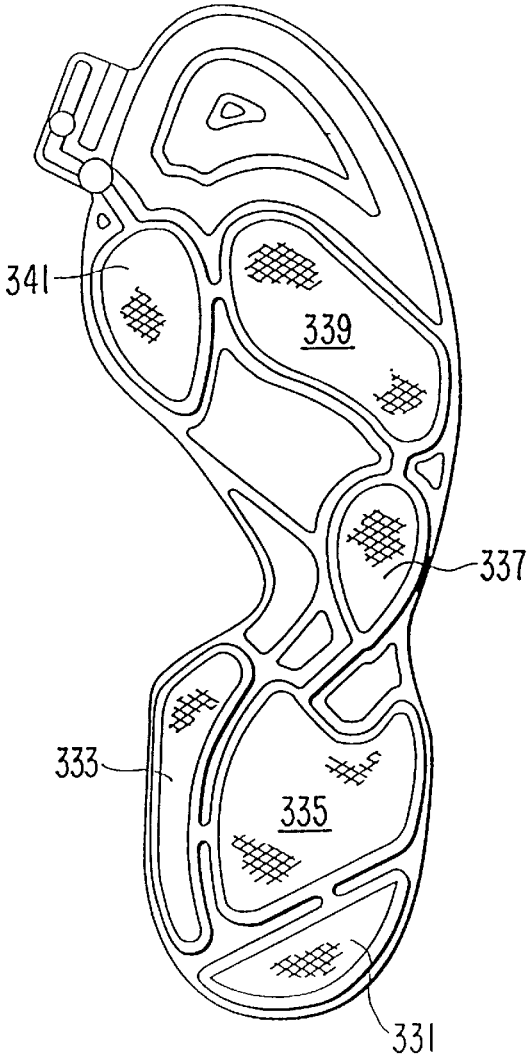
FIGS. 28–29 are bottom plan views similar to that shown in FIG. 27, showing alternative configurations of multi-chamber fluid bladders including tensile fabric members.
Figure 29:
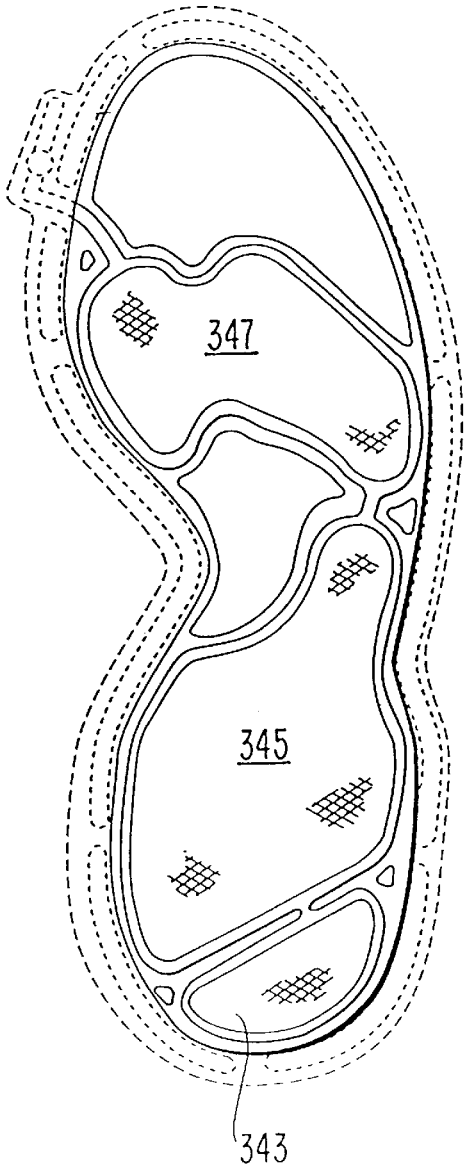

FIGS. 28–29 show further alternative configurations of multi-chamber fluid bladders employing the technology of the Rudy '502 and '361 patents. Similar to the embodiment of FIG. 27, the embodiments of FIGS. 28 and 29 are each configured such that a division of relatively flexible bladder material forms a line flexion delimiting a rearfoot strike zone including a bladder chamber. Referring to the embodiment of FIG. 28, a rearfoot strike zone has therein a first bladder chamber 331 exhibiting a lower fluid pressure (and hence lesser degree of compressive stiffness) than a second bladder chamber 333 extending along a medial side portion of the heel. Nested between the first and second bladder chambers 331, 333 is a third bladder chamber 335 extending within a central heel area and along a forward lateral side of the heel area. Unlike the embodiment of FIG. 27, wherein bladder chamber 313 extends up along a lateral side of the mid-foot region, bladder chamber 335 of the FIG. 28 embodiment is confined to the rearfoot area, and a separate small chamber 337 is provided in the lateral mid-foot region. In the forefoot region, separate chambers 339, 341 take the place of a single bladder chamber extending from the lateral to medial side in the region corresponding to the ball of the foot.

Referring now to the embodiment of FIG. 29, a rearfoot strike zone includes a first bladder chamber 343 exhibiting a lower fluid pressure (and hence lesser degree of compressive stiffness) relative to a large second bladder chamber 345 occupying substantially the entire remaining rearfoot area (extending along the lateral and medial sides, and within the central rearfoot area) and extending forward into the lateral mid-foot region. A fourth bladder chamber 347 extends from the lateral to medial side in a forefoot area, specifically in the region generally corresponding to the ball of the foot, as in the FIG. 27 embodiment.

The embodiments of FIGS. 21–29 are further examples of the numerous configurations that can be employed within the scope of the originally disclosed invention. Many different bladder shapes, volumes and pressures, and sole constructions, can be utilized within the general parameters specified herein (and in the parent application) for attaining enhanced cushioning effects without degrading stability. In addition to varying bladder chamber volumes and pressures, different bladder materials and chamber wall thicknesses can be used to vary the cushioning of the sole in accordance with the principles of the present invention. The particular gas(es) contained in the bladder can also be selected to vary the cushioning effect. While each of the embodiments of FIGS. 21–29 is in a form employing a unitary multi-chamber fluid bladder, it will be readily appreciated that similar cushioning and stability characteristics can be obtained by providing corresponding patterns of separate individual bladders.

The invention has been described in terms of presently preferred embodiments thereof. Other embodiments and modifications within the scope and spirit of the invention will, given this disclosure, occur to persons skilled in the art.

We claim:

1. Athletic footwear comprising an upper and a sole attached to said upper;

said sole including a cushioning portion extending over a heel area of said sole, and a rearfoot strike zone located at a rear lateral corner of said heel area, said rearfoot strike zone being articulated in relation to the remaining heel area along a line of flexion delimiting said rearfoot strike zone;

said cushioning portion comprising differential cushioning means for reducing the compressive stiffness of the rearfoot strike zone relative to at least a medial side portion of the remaining heel area, said differential cushioning means including a first sealed resilient substantially gas-filled bladder chamber extending within said rearfoot strike zone and not inside said medial side portion, said chamber occupying a major part of said rearfoot strike zone and providing a generally uniform compressive stiffness there across, which uniform compressive stiffness is reduced relative to the compressive stiffness of said medial side portion;

wherein, said line of flexion extends from a first end located along a rear medial side of the sole to a second end located along a lateral side of the sole, said second end being adjacent to or rearward of a nominal location of the junction of the calcaneus and cuboid bones of the foot, and said first end being located such that a line drawn from a nominal location of the weight bearing center of the heel to said first end forms a 10° to 50° angle with respect to a central longitudinal axis of the sole.

2. Athletic footwear according to claim 1, further comprising a second resilient substantially gas-filled bladder chamber fluidically isolated from the first chamber and extending along at least a medial side of said remaining heel area and not inside said rearfoot strike zone, the compressive stiffness of said first chamber being decreased relative to said second chamber.

3. Athletic footwear according to claim 2, wherein said second chamber has a sidewall portion which is substantially wholly exposed to form a flexible sidewall of the sole extending along said medial side of the remaining heel area.

4. Athletic footwear according to claim 2, wherein said first chamber has a lower fluid pressure than said second chamber.

5. Athletic footwear according to claim 2, wherein said first and second bladder chambers comprise first and second chambers of a segmented bladder, said first chamber and second chamber being articulated with respect to each other through a relatively flexible bladder portion, said line of flexion being formed along at least a portion of said relatively flexible bladder portion.

6. Athletic footwear according to claim 1, wherein said first chamber has a sidewall portion which is substantially wholly exposed between said first and second ends of the line of flexion to form a flexible sidewall of the sole.

7. Athletic footwear according to claim 1, wherein said line of flexion is formed along a groove opening to a bottom surface of said sole.

8. Athletic footwear according to claim 7, wherein said groove varies in depth along its length.

9. Athletic footwear according to claim 1, wherein said line of flexion is formed along at least two separate grooves opening to a bottom surface of said sole.

10. Athletic footwear according to claim 1, wherein said second end of the line of flexion is adjacent to said nominal location of the junction of the calcaneus and cuboid bones of the foot.

11. Athletic footwear according to claim 1, wherein said line of flexion extends linearly between said first and second ends thereof.

12. Athletic footwear according to claim 1, wherein said line of flexion is arcuate along at least a portion of its length.

13. Athletic footwear according to claim 1, further comprising a second substantially gas-filled bladder chamber extending within a central portion of said remaining heel area, about and below a nominal location of the weight bearing center of the heel.

14. Athletic footwear according to claim 13, wherein said first and second fluid chambers are in fluid communication with each other.

15. Athletic footwear according to claim 13, wherein said first and second chambers are fluidically isolated from each other, and said first chamber is inflated to a lower pressure than said second chamber.

16. Athletic footwear according to claim 13, wherein said first and second bladder chambers comprise first and second chambers of a segmented bladder, said first chamber and second chamber being articulated with respect to each other through a relatively flexible bladder portion, said line of flexion being formed along at least a portion of said relatively flexible bladder portion.

17. Athletic footwear according to claim 1, wherein said sole comprises a midsole and outsole, and said line of flexion is formed along a flex joint defined by a gap-forming discontinuity in said outsole.

18. Athletic footwear according to claim 17, wherein said gap-forming discontinuity is left open.

19. Athletic footwear according to claim 17, wherein said flex joint is further defined by a gap-forming discontinuity in said midsole.

20. Athletic footwear according to claim 1, wherein said first bladder chamber is formed by a single chamber bladder wholly contained within said rearfoot strike zone.

21. Athletic footwear according to claim 1, further comprising a relatively rigid motion control device attached to said sole outside of said rearfoot strike zone and providing increased resistance to compression in said medial side portion relative to a lateral side portion of said sole.

22. Athletic footwear according to claim 21, wherein said motion control device comprises a generally vertically extending rigid support affixed to a medial side of said sole.

* * * * *